US006231319B1

(12) United States Patent
Iida et al.

(10) Patent No.: US 6,231,319 B1
(45) Date of Patent: May 15, 2001

(54) HERMETIC COMPRESSOR

(75) Inventors: Noboru Iida; Kiyoshi Sawai, both of Shiga (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/249,114

(22) Filed: Feb. 12, 1999

(30) Foreign Application Priority Data

Feb. 13, 1998 (JP) ..... 10-049017
Feb. 13, 1998 (JP) ..... 10-049019
May 7, 1998 (JP) ..... 10-140605

(51) Int. Cl.[7] ..... F04B 19/02; F04B 27/06; F04B 37/00

(52) U.S. Cl. ..... 417/462; 417/437; 418/54

(58) Field of Search ..... 417/437, 460, 417/521, 902; 418/54, 58, 60, 64, 68, 75, 210, 221

(56) References Cited

U.S. PATENT DOCUMENTS 3,883,273 * 5/1975 King ..... 417/410.3
4,207,736 * 6/1980 Loo ..... 60/39.34
4,764,097 * 8/1988 Hirahara et al. ..... 418/60
5,666,015 * 9/1997 Uchibori et al. ..... 310/261

FOREIGN PATENT DOCUMENTS 863751 1/1953 (DE) .
430830 6/1935 (GB) .

* cited by examiner

*Primary Examiner*—Teresa Walberg
*Assistant Examiner*—Thor Campbell

(74) *Attorney, Agent, or Firm*—Armstrong, Westerman, Hattori, McLeland & Naughton, LLP

(57) ABSTRACT

A hermetic compressor includes a plurality of compressing mechanisms. Each of the compressing mechanism includes a rotary cylinder having a groove, and a piston slidable in the groove, so that a compressing stroke is carried out by rotation of said piston on a locus of a radius E about a point spaced apart at a distance E from the center of said rotary cylinder. A partition plate is interposed between the rotary cylinders of the adjacent compressing mechanisms. The partition plate is provided with a communication bore through which a shaft is passed. The partition plate is provided with cranks on which said pistons can be mounted. A motor mechanism section is adapted to drive the pistons of the compressing mechanisms by the common shaft. At least one of the compressing mechanisms is different in phase in a compressing stroke from the other compressing mechanisms. The rotary cylinders of the adjacent compressing mechanisms and said partition plate sandwiched between such rotary cylinders are formed from different members, and relatively non-rotatably connected to each other. Thus, the piston rotated in the above manner about the above-described point is not necessarily requited to be rotated about its axis during the rotating movement about such point, and need be only slid along the groove. Therefore, the piston can be formed into a non-circular shape, whereby the area of contact of the piston with the groove can be increased to enhance the sealability, thereby enhancing the suction and compression efficiency.

16 Claims, 16 Drawing Sheets

PRIOR ART

HERMETIC COMPRESSOR

TECHNICAL FIELD

The present invention relates to a hermetic compressor used in a refrigeration cycle system.

BACKGROUND ART

There is a conventionally proposed principle of a compressing mechanism which includes a rotary cylinder having a groove, and a piston slidable within the groove, so that the rotary cylinder is rotated in accordance with the movement of the piston to perform suction and compression strokes (for example, see German Patent No. 863,751 and British Patent No. 430,830).

The conventionally proposed principle of the compressing mechanism will be described below with reference to FIG. 26.

The compressing mechanism is comprised of a rotary cylinder 101 having a groove 100, and a piston 102 which is slidable within the groove 100. The rotary cylinder 101 is provided for rotation about a point A, and the piston 102 is rotated about a point B.

The movements of the piston and the cylinder will be described as for a case where the rotational radius of the piston 102 is equal to the distance between the center A of rotation of the rotary cylinder 101 and the center B of rotation of the piston 102.

When the rotational radius of the piston 102 is larger, or smaller than the distance between the rotational center A of the rotatable cylinder 101 and the rotational center B of the piston 102, different movements are performed. The description of these different movements is omitted herein.

A broken line C in FIG. 26 indicate a locus for the piston 102.

FIGS. 26*a* to 26*i* show states in which the piston 102 has been rotated through every 90 degree.

First, the movement of the piston 102 will be described below. FIG. 26*a* shows the state in which the piston lies immediately above the rotational center B. FIG. 26*b* shows the state in which the piston 102 has been rotated through 90 degree in a counterclockwise direction from the state shown in FIG. 26*a*. FIG. 26*c* shows the state in which the piston 102 has been rotated through 180 degree in the counterclockwise direction from the state shown in FIG. 26*a*. FIG. 26*d* shows the state in which the piston 102 has been further rotated through 270 degree in the counterclockwise direction from the state shown in FIG. 26*a*. FIG. 26*e* shows the state in which the piston 102 has been rotated through 360 degree in the counterclockwise direction from the state shown in FIG. 26*a* and has been returned to the state shown in FIG. 26*a*.

The movement of the rotary cylinder 102 will be described below. In the state shown in FIG. 26*a*, the rotary cylinder 101 is located, so that the groove 100 is located vertically. When the piston 102 is moved through 90 degree in the counterclockwise direction from this state, the rotary cylinder 101 is rotated through 45 degree in the counterclockwise direction, as shown in FIG. 26*b* and hence, the groove 100 is likewise brought into a state in which it is inclined at 45 degree When the piston 102 is rotated through 180 degree in the counterclockwise direction from the state shown in FIG. 26*a*, the rotary cylinder 101 is rotated through 90 degree in the counterclockwise direction, as shown in FIG. 26*c* and hence, the groove 100 is likewise brought into a state in which it is inclined at 90 degree.

In this way, the rotary cylinder 101 is rotated in the same direction with the rotation of the piston 102, but while the piston 102 is rotated through 360 degree, the rotary cylinder 101 is rotated through 180 degree.

The change in volume of the groove 100 defining the compressing space will be described below.

In the state shown in FIG. 26*a*, the piston 102 lies at one end in the groove 100 and hence, only one space 100 exists. This space 100 is called a first space 100*a* herein. In the state shown in FIG. 26*b*, the first space 100*a* is narrower, but a second space 100*b* is produced on the opposite side of the piston 102. In the state shown in FIG. 26*c*, the first space 100*a* is as small as half of the space in the state shown in FIG. 26*a*, but a second space 100*b* of the same size as the first space 100*a* is defined on the opposite side of the piston 102. The first space 100*a* is zero in volume in the state shown in FIG. 26*e* in which the piston 102 has been rotated through 360 degree.

In this way, the two spaces 100*a* and 100*b* are defined by the piston 102 and repeatedly varied in volume from the minimum to the maximum and from the maximum to the minimum, whenever the piston 102 is rotated through 360 degree.

Therefore, the spaces defining the compressing chambers perform the compression and suction strokes by the rotation of the piston 102 through 720 degree.

It is a main object of the present invention to utilize the above-described compressing principle in the hermetic compressor.

The above-described compressing principle suffers from the following problem: When the piston 102 is at the center A of rotation of the rotary cylinder 101, the direction of a force provided by the rotational force of the piston 102 is the same as the direction of the groove 100 and hence, this force does not serve a force for rotating the rotary cylinder 101. Therefore, when the piston 102 is at the center A of rotation of the rotary cylinder 101, the above-described movement is actually continuously not performed, if the rotational force is not applied to the rotary cylinder 101.

A continuous movement is realized by using a plurality of compressing mechanisms synchronized with each other with different phases. More specifically, by using a plurality of compressing mechanisms synchronized with each other with different phases, the rotational force of one of the rotatable cylinders can be applied to the other rotatable cylinder. Therefore, even if either one of the rotatable cylinders is brought into a state in which it does not receive the rotational force from the piston, the other rotatable cylinder applies the rotational force to the one rotatable cylinder and hence, the rotation can be continuously maintained.

However, when the plurality of compressing mechanisms with different phases are used, the compressing strokes in the compressing chambers in the compressing mechanisms are different from each other. For this reason, a partition plate for isolating the adjacent compressing mechanisms is required. To ensure a smooth rotation, the synchronization of the plurality of compressing mechanisms must be made reliable.

Accordingly, it is an object of the present invention to provide a hermetic compressor using a plurality of compressing mechanisms with different phases, wherein the synchronization of the plurality of compressing mechanisms can be made reliable.

It is another object of the present invention to provide a hermetic compressor, wherein the reliable synchronization of the compressing mechanisms can be realized by a particular structure capable of being industrially produced.

It is a further object of the present invention to provide a hermetic compressor, wherein a high suction efficiency can be realized.

It is a yet further object of the present invention to provide a hermetic compressor, wherein a high compressing efficiency can be realized.

Further, it is an object of the present invention to provide a hermetic compressor, wherein a non-circular piston is employed, and the area of contact between a rotary cylinder and the piston is increased to enhance the sealability and to enhance the sucking and compressing efficiencies.

SUMMARY OF THE INVENTION

To achieve the above objects, according to a first aspect and feature of the present invention, there is provided a hermetic compressor comprising a plurality of compressing mechanisms each of which includes a rotary cylinder having a groove, and a piston which is slidable in the groove, so that a compressing stroke is carried out by rotation of the piston on a locus of a radius E about a point spaced apart at a distance E from the center of the rotary cylinder; a partition plate being interposed between the rotary cylinders of the adjacent compressing mechanisms, the partition plate being provided with a communication bore through which a shaft is passed, the shaft being provided with cranks on which the pistons can be mounted; and a motor mechanism for driving the pistons of the compressing mechanisms by the common shaft, at least one of the compressing mechanisms being different in phase in a compressing stroke from the other compressing mechanisms, the rotary cylinders of the adjacent compressing mechanisms and the partition plate sandwiched between these rotary cylinders being formed from different members, and relatively non-rotatably connected to each other.

With the above arrangement, two spaces are defined in the groove by the piston. The volumes of the spaces are varied by the sliding movement of the piston and hence, the compression and suction can be carried out. In this way, the compressing mechanism carries out the compression and suction only by the rotating movements of the rotary cylinder and the piston, and does not require a member moved diametrically such as a vane required in a rotary compressor and an Oldham's ring required in a scroll compressor. Therefore, it is possible to realize a hermetic compressor which produces only an extremely small amount of vibration, even if the compressor mechanism section is fixed within the shell. In the hermetic compress or according to the present invention, the piston rotated in the above manner about the above-described point is not necessarily requited to be rotated about its axis during the rotating movement about such point, and need be only slid along the groove. Therefore, the piston can be formed into a non-circular shape, whereby the area of contact of the piston with the groove can be increased to enhance the sealability, thereby enhancing the suction and compression efficiency.

Thus, even if the piston is located at the center of the rotary cylinder in one of the compressor mechanism sections, it can be avoided that the driving force from the piston does not serve as a rotating force for the rotary cylinder, because the other compressing mechanism provides a rotating force.

According to a second aspect and feature of the present invention, in addition to the first feature, the rotary cylinder and the partition plate are formed of disks, respectively.

With the above arrangement, to make the groove in the rotary cylinder and the partition plate, the rotary cylinder and the partition plate can be machined easily and with a good accuracy without accompanying of a difficult operation.

According to a third aspect and feature of the present invention, in addition to the second feature, the rotary cylinder and the partition plate have through-bores defined therein, respectively, so that the rotary cylinder and partition plate are fixed by bolts inserted through the through-bores, the through-bores being disposed at locations where they are not aligned with an intake port and a discharge port for permitting a gas to flow into and out of the compressing mechanism.

With the above arrangement, a lower-pressure gas and a higher-pressure gas cannot flow into the through-bores in every rotation of the cylinder and hence, it is possible to prevent a reduction in efficiency due to the provision of the through-bores.

According to a fourth aspect and feature of the present invention, in addition to the third feature, the through-bore defined in the rotary cylinder is provided with a larger-diameter portion for receiving a head of the bolt.

With the above arrangement, the head of the bolt cannot protrude from the rotary cylinder and hence, to machine a member facing the bolt head, it is unnecessary to make a groove in this member for avoiding the interference with the bolt head and thus, the hermetic compressor can be produced at a lower cost.

According to a fifth aspect and feature of the present invention, in addition to the second feature, the rotary cylinder and the partition plate have through-bore defined therein, respectively, so that the rotary cylinder and the partition plate are fixed by pins fitted into the through-bores, the through-bores being disposed at locations where they are not aligned with an intake port and a discharge port for permitting a gas to flow into and out of the compressing mechanism.

With the above arrangement, a lower-pressure gas or a higher-pressure gas cannot flow into the through-bores in every rotation and hence, it is possible to prevent the reduction in efficiency due to the provision of the through-bores.

According to a sixth aspect and feature of the present invention, in addition to the second feature, the partition plate has pin-insertion bores defined therein, and each of the rotary cylinders located on opposite sides of the partition plate has bottomed pin-receiving bores defined therein, so that the relative rotation of the rotary cylinders of the adjacent compressing mechanisms is limited by pins inserted into the pin-receiving bores and the pin insertion bores.

With the above arrangement, a gas cannot flow into and out of the compressing mechanism through the bottomed pin receiving bores in the rotary cylinder. This provides an increased degree of freedom in design concerning the positions for disposition of and the sizes of the intake port and the discharge port. As a result, it is possible to select a port shape in which intake and discharge losses are small, and hence, it is possible to enhance the efficiency of the compressor.

According to a seventh aspect and feature of the present invention, in addition to the second feature, the rotary cylinder and the partition plate are fitted in a recess-projection manner with each other by a recess and a projection formed on opposed faces thereof.

With the above arrangement, the adjacent rotary cylinders can be separated from each other, while limiting the relative angle of the rotary cylinder by the fitting of the rotary cylinder and the partition plate. Therefore, a gas force applied to one of the rotary cylinders is not transmitted to the other rotary cylinder and as a result, the rotary cylinders cannot be inclined together during rotation thereof. Thus, it is possible to prevent the partial abutment of the rotary cylinder against the member which is sliding contact with the rotary cylinder to reduce the sliding wear of the outer peripheral surface of the rotary cylinder.

According to an eighth aspect and feature of the present invention, in addition to the second feature, the rotary cylinder and the partition plate are fixed to each other by welding.

With the above arrangement, a working technique commonly used in the machining can be utilized, thereby preventing the relative rotation between the adjacent rotary cylinders.

According to a ninth aspect and feature of the present invention, there is provided a hermetic compressor comprising a plurality of compressing mechanisms each of which includes a rotary cylinder having a groove, and a piston which is slidable in the groove, so that a compressing stroke is carried out by rotation of the piston on a locus of a radius E about a rotational center provided by a location spaced at a distance E apart from the center of the rotary cylinder; a partition plate being interposed between said rotary cylinders of the adjacent compressing mechanisms, the partition plate being provided with a communication bore through which a shaft is passed, the shaft being provided with cranks on which the pistons can be mounted; and a motor mechanism for driving the pistons of the compressing mechanisms by the common shaft, at least one of the compressing mechanisms being different in phase in a compressing stroke from the other compressing mechanism, the rotary cylinders of the adjacent compressing mechanisms and the partition plate sandwiched between these rotary cylinders being formed from an integrally formed piece.

With the above arrangement, it is unnecessary to provide a means for connecting the rotary cylinder and the partition plate which are separate from each other, as in the arrangement of any of the first to eighth features, and it is unnecessary to provide through-bores in the rotary cylinder, as in the arrangement of the third feature. This provides an increased freedom degree in design concerning the positions for disposition of and the sizes of an intake port and a discharge port. As a result, it is possible to select a port shape in which intake and discharge losses are small, and hence, it is possible to enhance the efficiency of the compressor.

According to a tenth aspect and feature of the present invention, there is provided a hermetic compressor comprising first and second compressing mechanisms each of which includes a rotary cylinder having a groove, and a piston which is slidable in the groove, so that a compressing stroke is carried out by rotation of the piston on a locus of a radius E about a rotational center provided by a location spaced at a distance E apart from the center of the rotary cylinder, all the rotary cylinders being connected together, all the pistons being driven by a common shaft, and the first and second compressing mechanisms being different in phase in a compressing stroke, the first and second compressing mechanisms being mounted between an upper bearing and a lower bearing, the upper bearing having an intake port and a discharge port provided therein for the first compressing mechanism, and the lower bearing having an intake port and a discharge port provided therein for the second compressing mechanism, the intake ports and the discharge ports being provided so that they do not communicate simultaneously with a compressive space defined by the rotary cylinder and the piston at all rotational angles of the shaft.

With the above arrangement, a high-pressure refrigerant gas cannot be leaked to the intake side through the compressive space during a compressing stroke and hence, a high suction efficiency (volume efficiency) can be realized.

According to an eleventh aspect and feature of the present invention, in addition to the tenth feature, the intake port is disposed so that it communicates with the compressive space which is in a volume-increasing course, at positions of all rotational angles excluding a suction starting point where the volume of the compressive space is smallest (minimum) and a suction completing point where the compressive space is largest (maximum).

With the above arrangement, the intake port cannot face the compressive space at the suction starting point and the suction completing point and hence, the intake port can be reliably cut off from the compressing stroke in the compressive space. Thus, a refrigerant gas cannot be leaked to the intake side during the compressing stroke and hence, a high suction efficiency can be realized. In addition, since the intake port communicates with the compressive space at all the suction stroke excluding the suction starting point and the suction completing point, the refrigerant gas is sucked through the intake port into the compressive space with a small pressure loss, when the volume of the compressive space is increased. As a result, a high suction efficiency can be realized.

According to a twelfth aspect and feature of the present invention, in addition to the eleventh feature, the intake port has a crescent shape extending along a side edge of the groove at a position of a rotational angle of the rotary cylinder at the time when the compressive space is smallest or largest, an outer edge of the crescent shape being formed into an arc conforming with and extending along a locus of movement of an end edge of the groove.

With the above arrangement, the intake port can be formed into a shape free from any sufficiency and shortage, which can be employed for the mechanism at the suction stroke excluding the suction starting point and the suction completing point. As a result, a high suction efficiency can be realized.

According to a thirteenth aspect and feature of the present invention, in addition to the tenth or twelfth feature, the discharge port is comprised of a plurality of ports spaced apart from one another along a side edge of the groove at a position of a rotational angle of the rotary cylinder at the time when the compressive space is smallest or largest, the plurality of ports being provided with discharge valves, respectively and disposed at locations where they do not communicate with the compressive space at a compression starting point and a compression completing point in the compressive space.

With the above arrangement, it is possible to avoid a phenomenon of leakage of refrigerant gas on the high-pressure side to the compressive space. In addition, the refrigerant gas in the compressive space is discharged via the plurality of discharge ports to the higher-pressure side, as the compressing stroke is advanced, while the compressive space is rotated. Therefore, a phenomenon of over-compression can be avoided, and a high compression efficiency can be realized.

According to a fourteenth aspect and feature of the present invention, there is provided a hermetic compressor comprising first and second compressing mechanisms which are mounted within a casing and each of which includes a rotary cylinder having a groove, and a piston which is slidable in the groove, so that the suction and compression are carried out by rotation of the piston on a locus of a radius E about a center provided by a point spaced at a distance E apart from the center of the rotary cylinder, the two rotary cylinders of the first and second compressing mechanisms being connected to each other at a location where the first and second compressing mechanisms are different in phase in a compressing stroke, the two pistons being driven by a common crankshaft, the piston being formed into a shape such that its sectional contour is comprised of two arcs and two parallel straight lines having a length a, the groove in the rotary cylinder being formed into a shape such that it is comprised of arcs assuming the substantially same shape as the arcs forming the piston, and two parallel straight. lines having a length of 4 E+a.

With the above arrangement, the piston and the groove are in face contact with each other rather than in line contact. As a result, the leakage of the refrigerant from the higher-pressure compressing chamber to the lower-pressure compressing chamber is reduced and hence, the suction and compression efficiencies can be enhanced. In this case, the piston and the groove in the rotary cylinder can be finished easily and with a high accuracy by a simple working machine such as a drilling machine, a lathe and a milling machine.

According to a fifteenth aspect and feature of the present invention, the sectional contour of the piston is formed by cutting a cylindrical member in parallel.

With the above arrangement, the suction and compression efficiencies can be enhanced, and flat faces of the piston comprised of the parallel straight lines may be formed on the contour of the cylindrical member fabricated by a working machine such as lathe and hence, the piston can be made extremely easily and with a high accuracy. Thus, the manufacturing cost can be reduced.

According to a sixteenth aspect and feature of the present invention, the arc forming the sectional contour of the piston is semi-circular.

With the above arrangement, the suction and compression efficiencies can be enhanced, and any corner is not created at the connection between the semi-circular arc and the straight line, leading to a smooth connection, whereby the sliding movement of the piston can be conducted smoothly.

The above and other objects and advantages of the invention will become apparent from the following description of the preferred embodiments in conjunction with the accompanying drawings.

BEST MODE FOR CARRYING OUT THE PRESENT INVENTION

Figure 5:
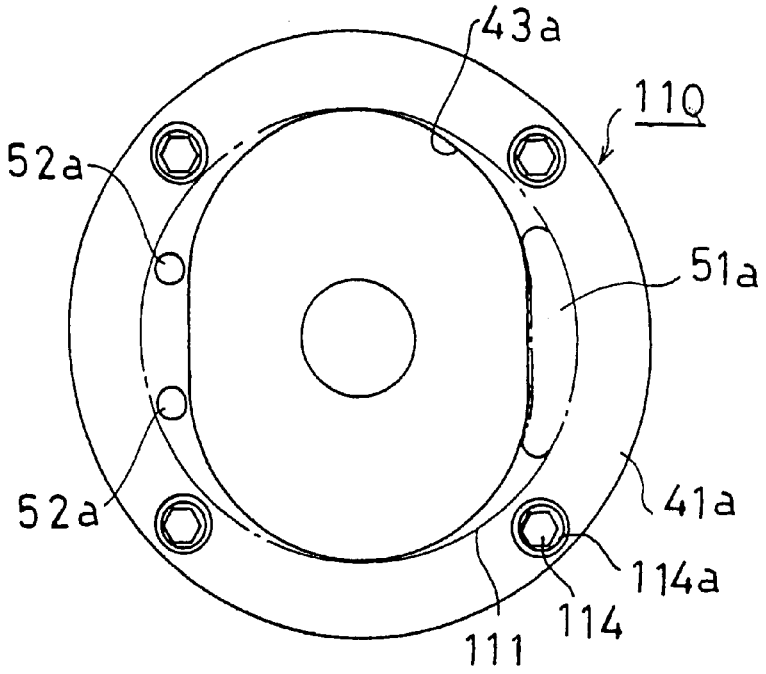
Figure 6:
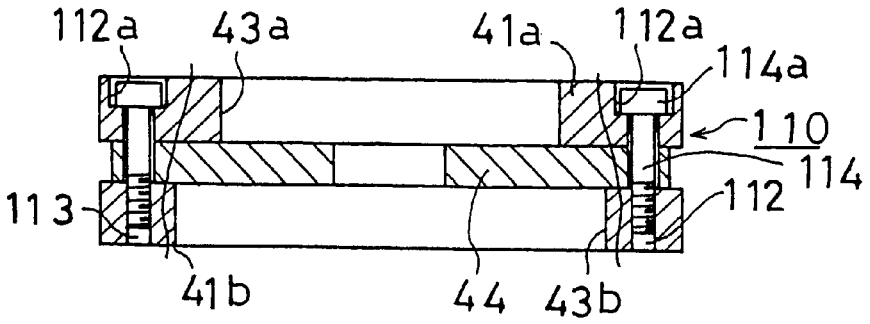
Figure 7:
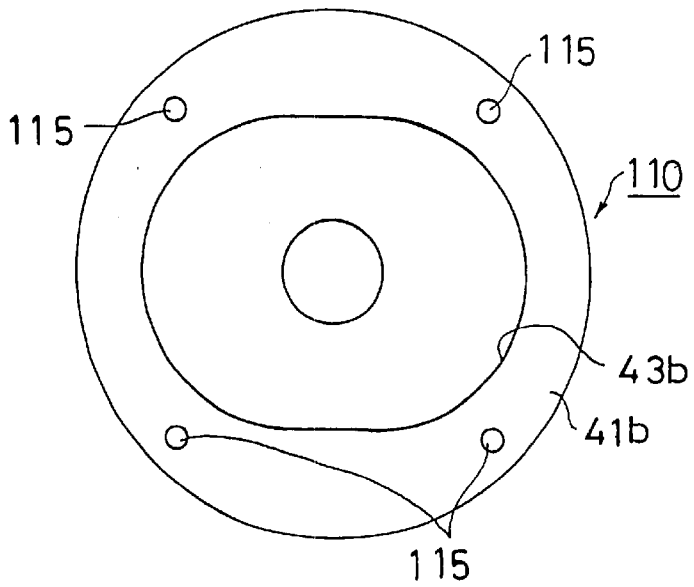
Figure 8:
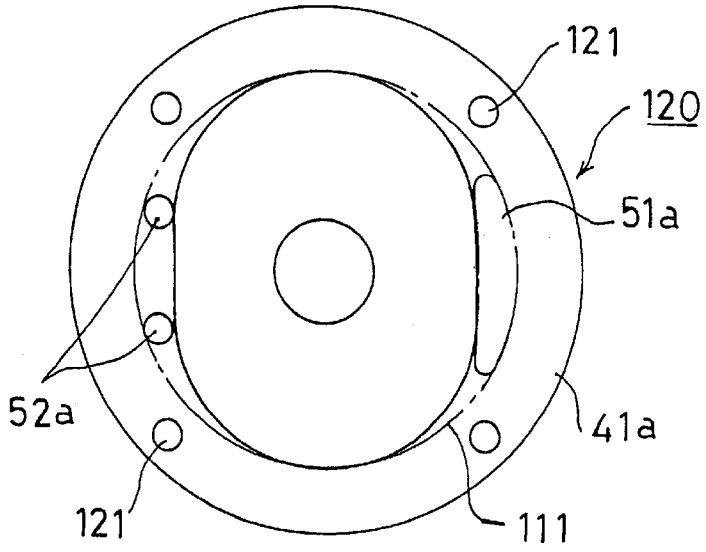
Figure 9:
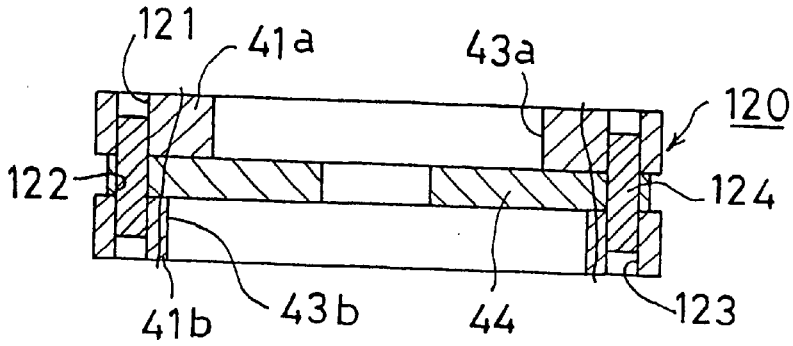
Figure 10:
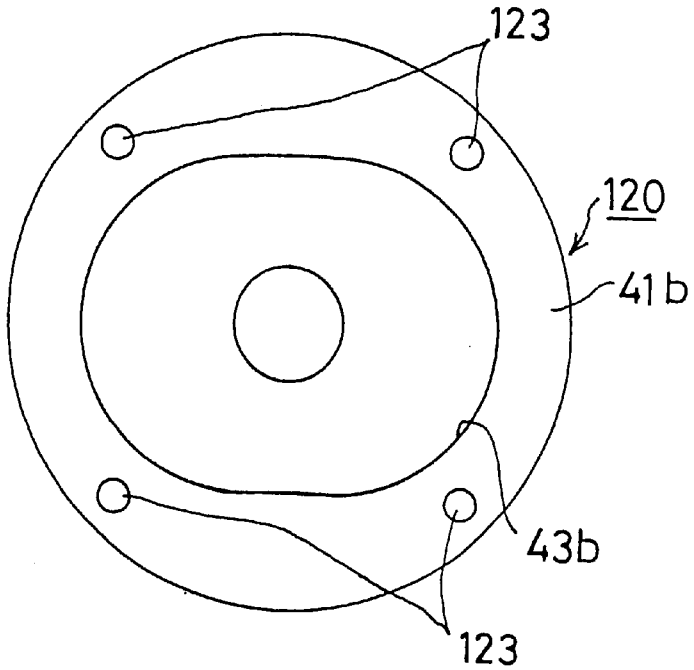
Figure 11:
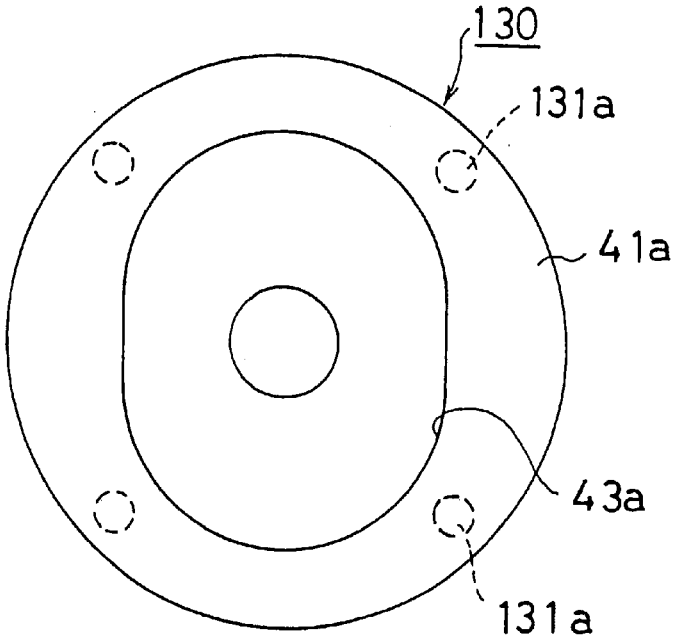
Figure 12:
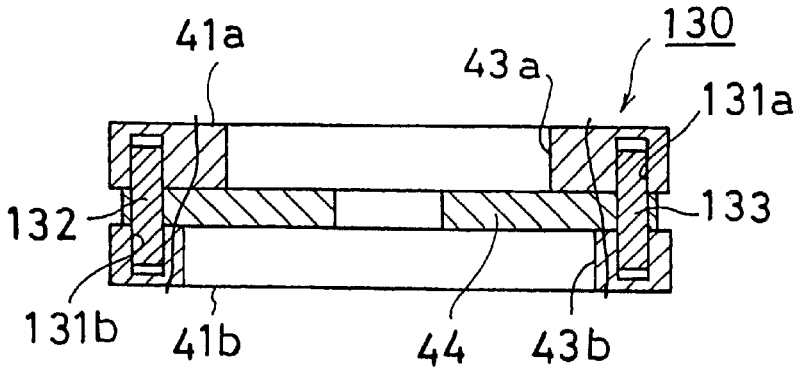
Figure 13:
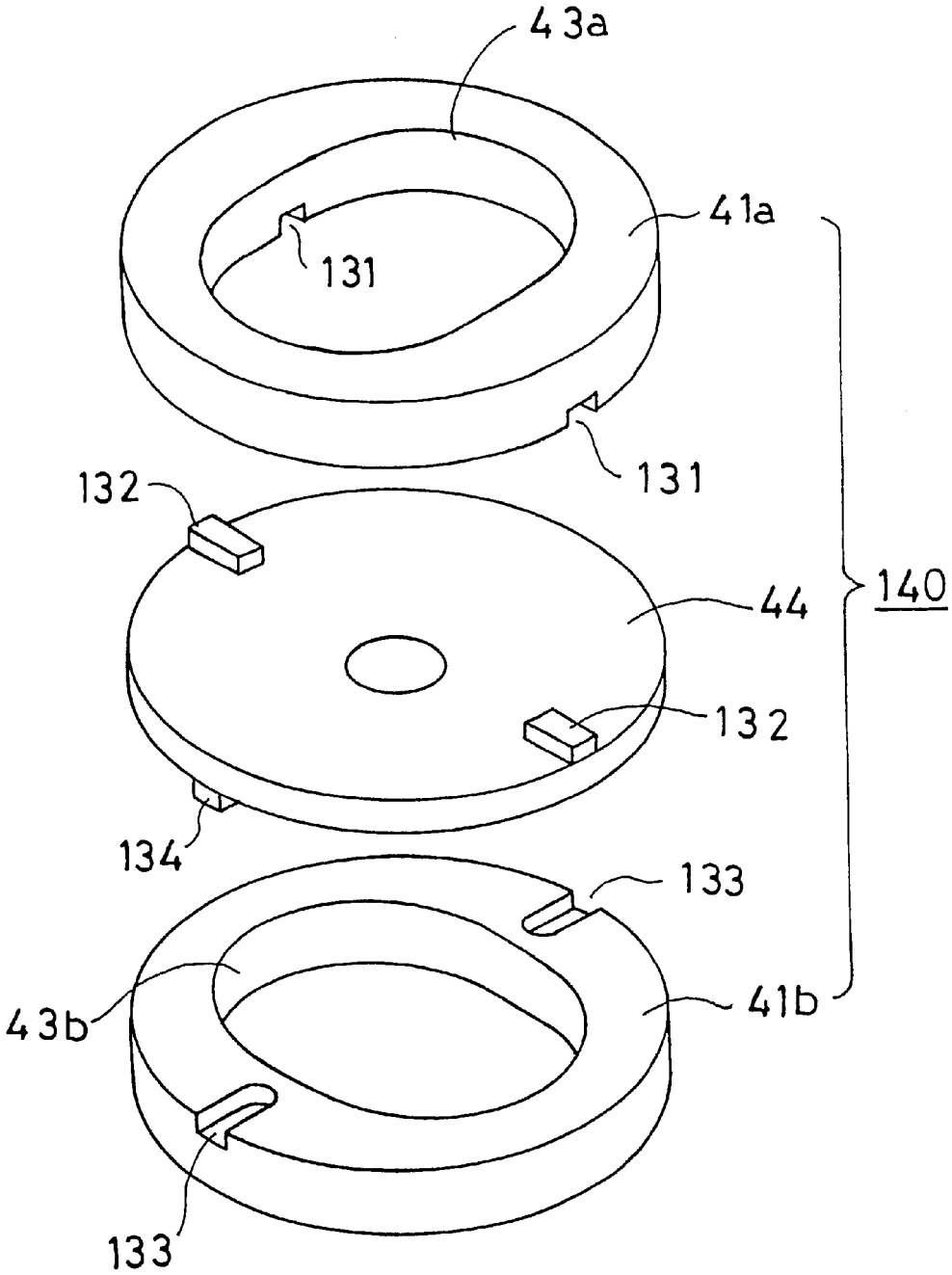
Figure 14:
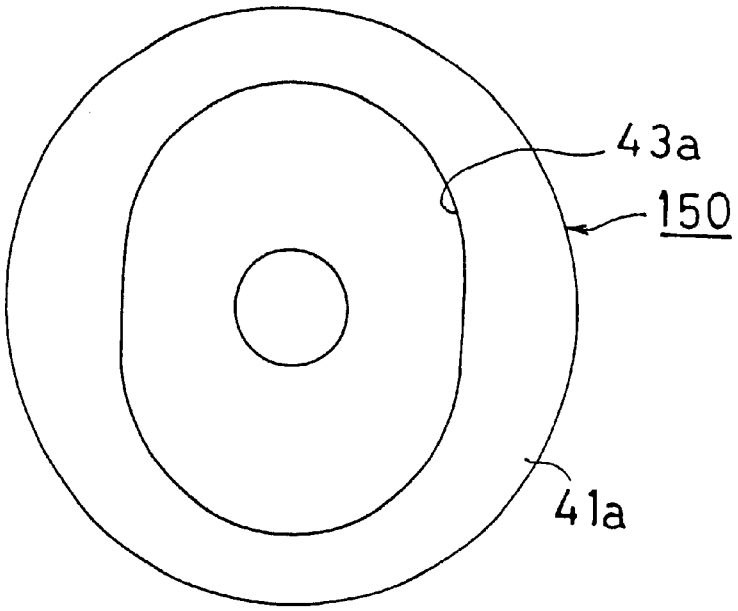
Figure 15:
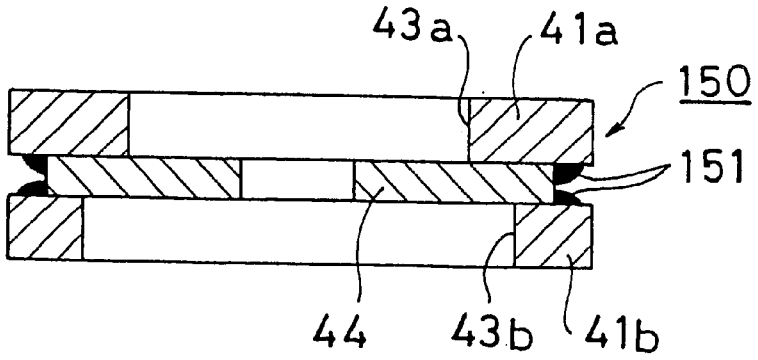
Figure 16:
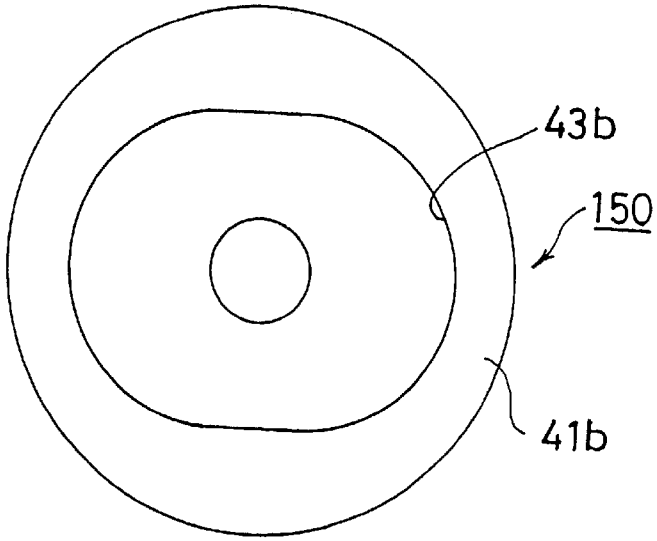
Figure 17:
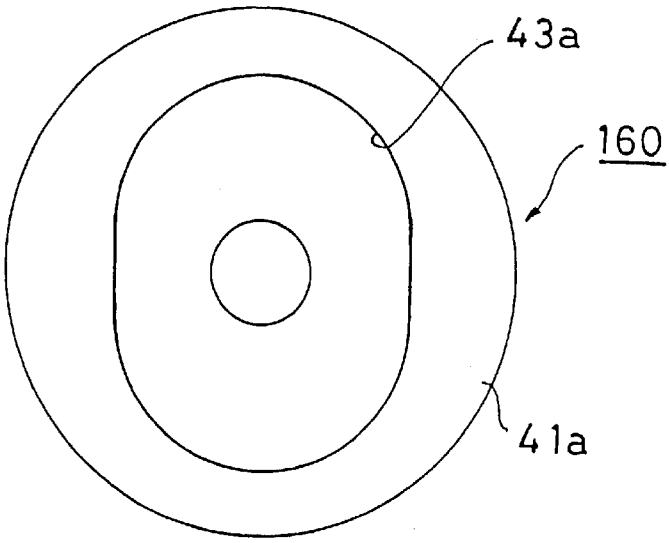
Figure 18:
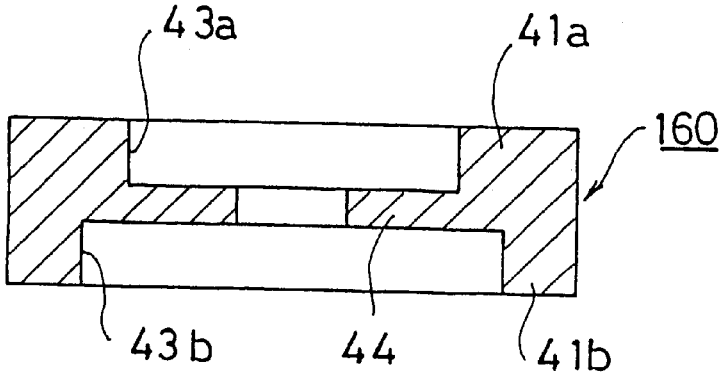
Figure 19:
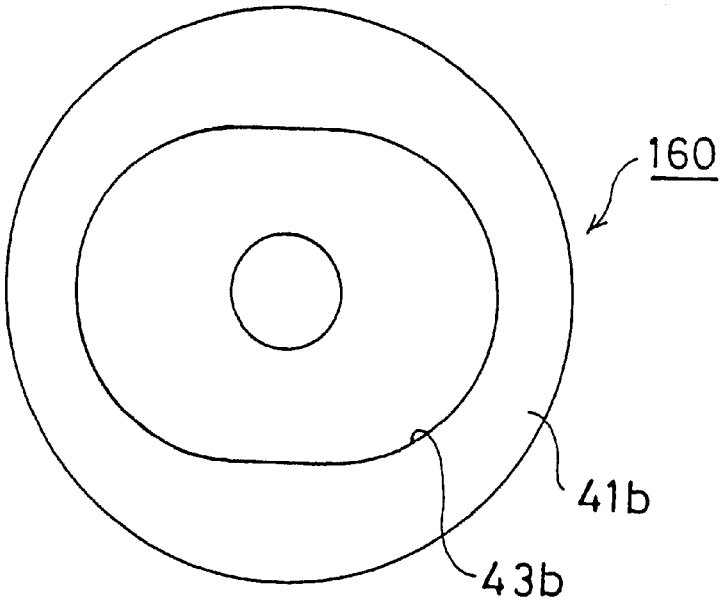
Figure 20:
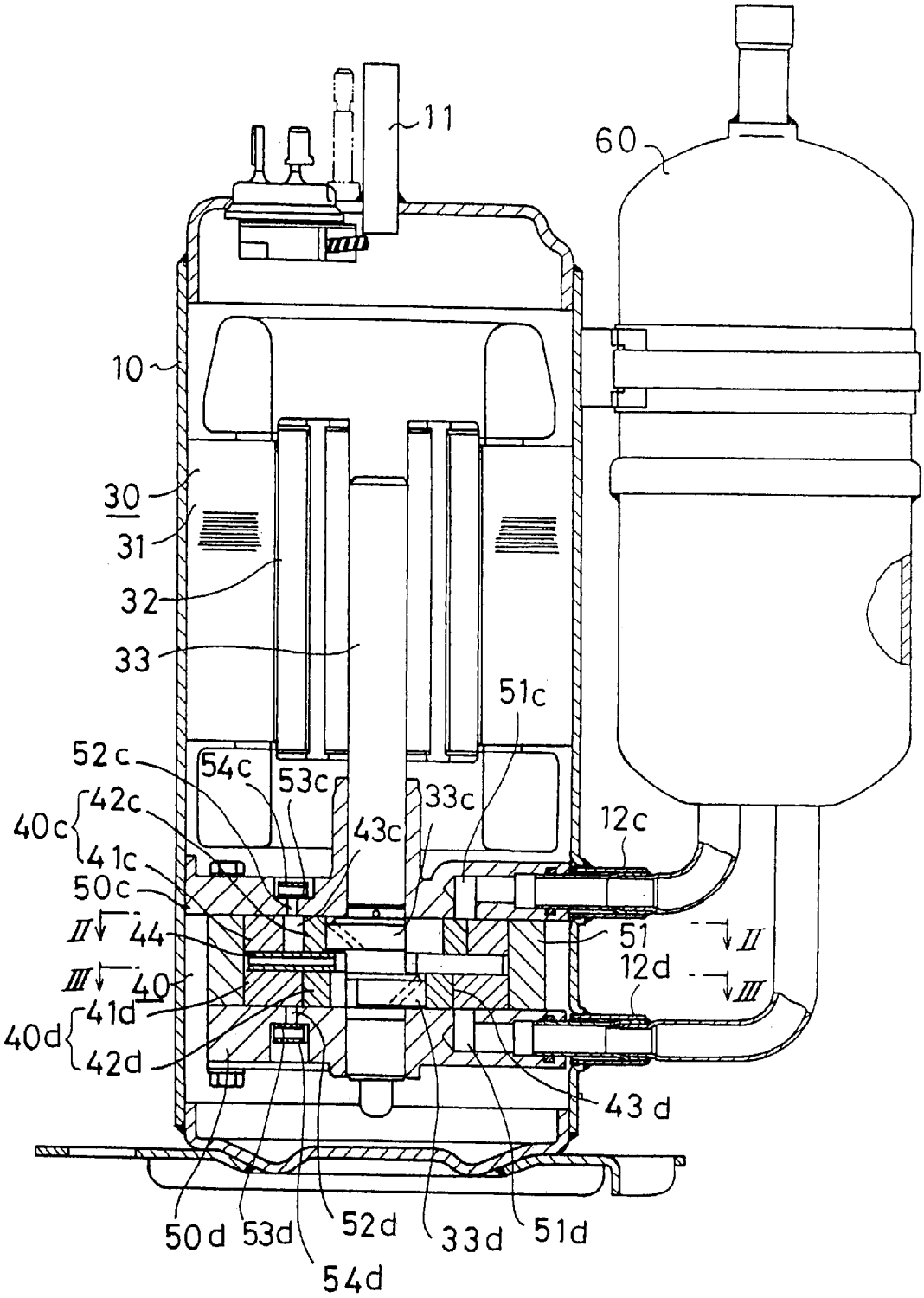
Figure 21:
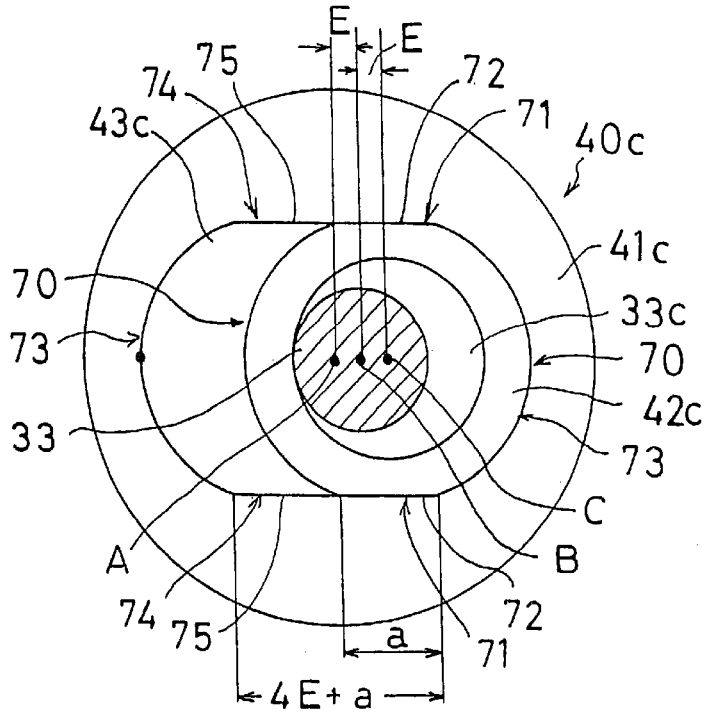
Figure 22:
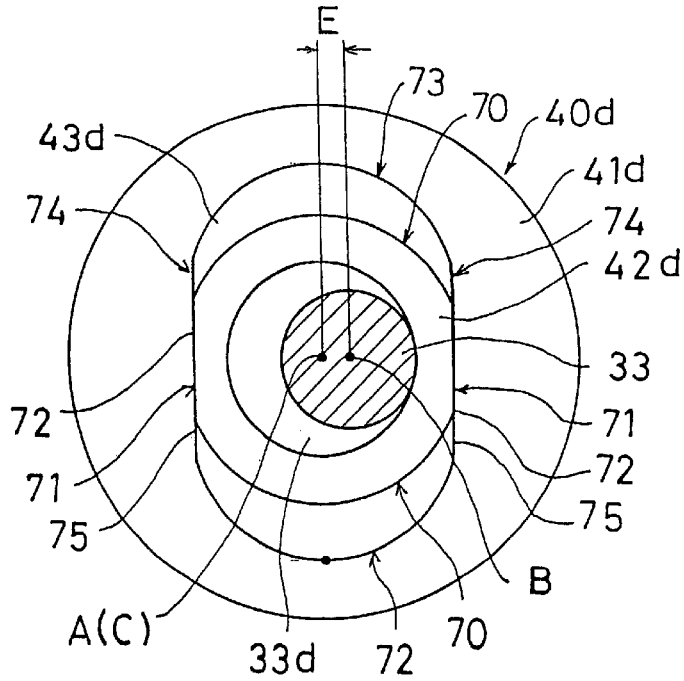
Figure 24:
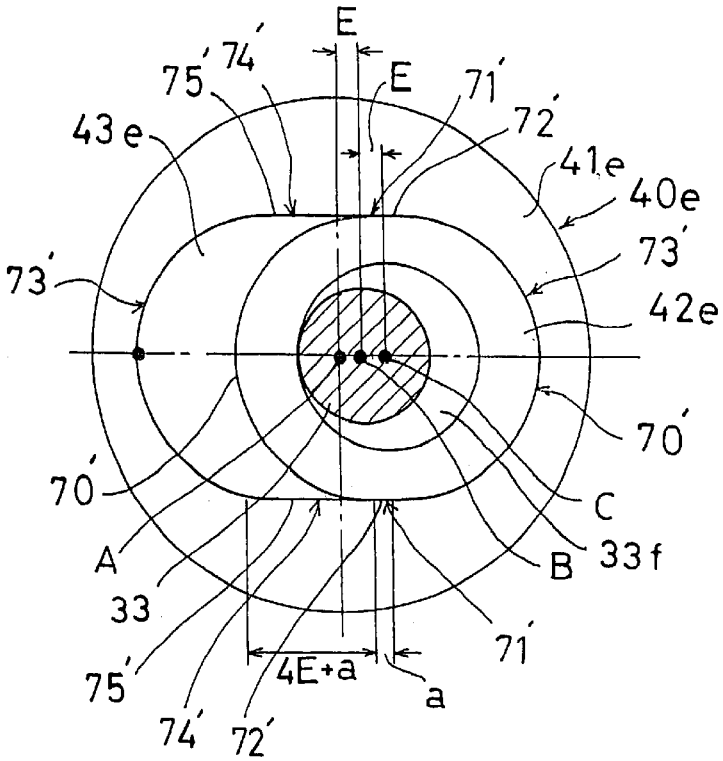
Figure 25:
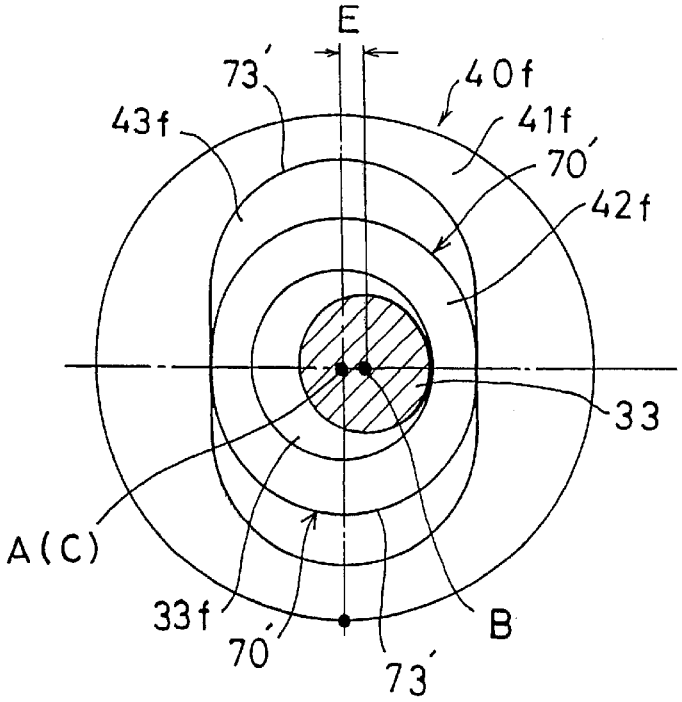
Figure 26:
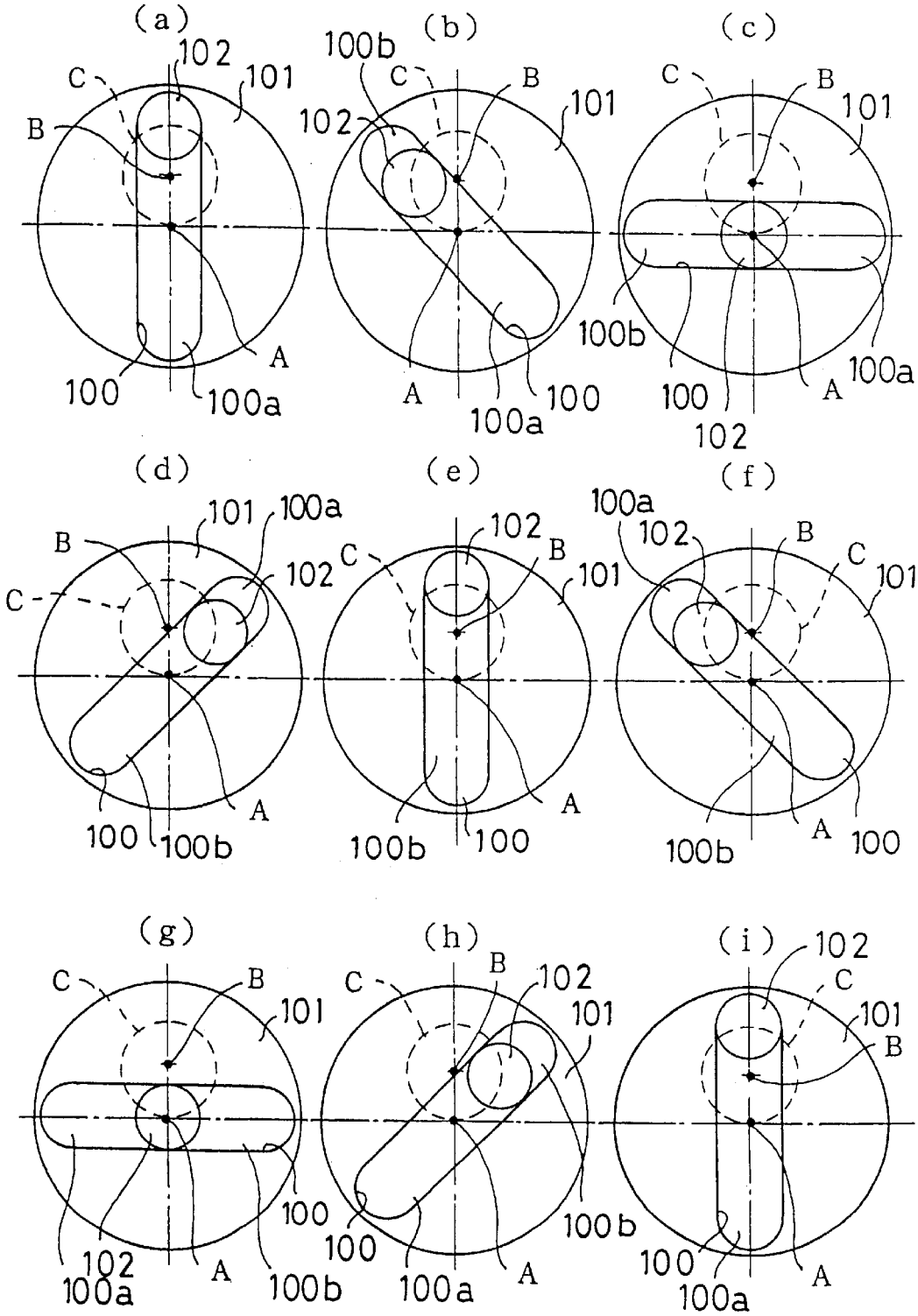

FIGS. 4*a* to 4*h* are views for explaining the operation of a compressing mechanism in the embodiment;

FIG. 5 is a plan view of a first assembly as viewed from the side of a first rotary cylinder;

FIG. 6 is a vertical sectional view of the first assembly shown in FIG. 5;

FIG. 7 is a plan view of the first assembly as viewed from the side of a second rotary cylinder;

FIG. 8 is a plan view of a second assembly as viewed from the side of a first rotary cylinder;

FIG. 9 is a vertical sectional view of the second assembly shown in FIG. 8;

FIG. 10 is a plan view of the second assembly as viewed from the side of a second rotary cylinder;

FIG. 11 is a plan view of a third assembly as viewed from the side of a first rotary cylinder;

FIG. 12 is a vertical sectional view of the third assembly shown in FIG. 11;

FIG. 13 is an exploded perspective view of a fourth assembly;

FIG. 14 is a plan view of a fifth assembly as viewed from the side of a first rotary cylinder;

FIG. 15 is a vertical sectional view of the fifth assembly shown in FIG. 14;

FIG. 16 is a plan view of the fifth assembly as viewed from the side of a second rotary cylinder;

FIG. 17 is a plan view of a sixth assembly as viewed from the side of a first rotary cylinder;

FIG. 18 is a vertical sectional view of the sixth assembly shown in FIG. 17;

FIG. 19 is a plan view of the sixth assembly as viewed from the side of a second rotary cylinder;

FIG. 20 is a vertical sectional view of the entire structure of the compressor according to another embodiment of the present invention;

FIG. 21 is a sectional view taken along a line II—II in FIG. 20 in the other embodiment;

FIG. 22 is a sectional view taken along a line III—III in FIG. 20 in the other embodiment;

FIGS. 23*a* to 23*h* are views for explaining the operation of a compressing mechanism in the other embodiment;

FIG. 24 is a view similar to the sectional view taken along the line II—II in FIG. 20, but according to a second embodiment;

FIG. 25 is a view similar to the sectional view taken along the line III—III in FIG. 20, but according to the second embodiment;

FIGS. 26*a* to 26*i* are views for explaining the principle of the compressing mechanism.

DETAILED DESCRIPTION OF THE PREFERRED EMBODIMENTS

The present invention will now be described by way of embodiments with reference to the accompanying drawings.

Figure 1:
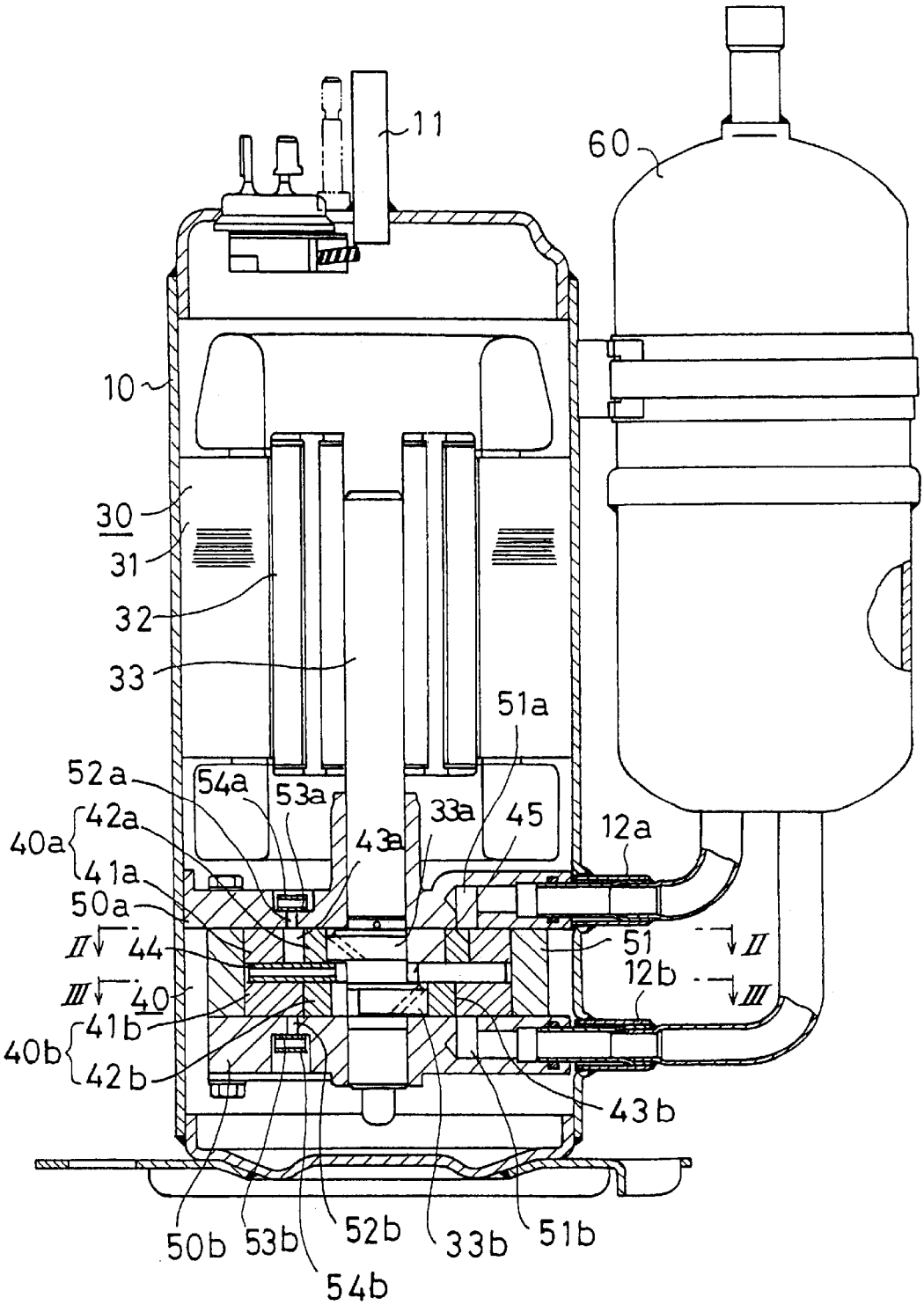
FIG. 1 is a vertical sectional view of a hermetic compressor according to an embodiment of the present invention.
Figure 2:
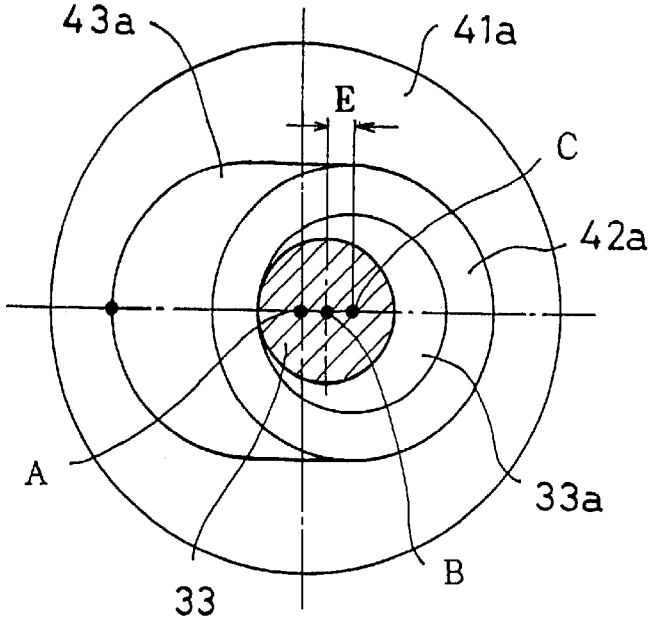
FIG. 2 is a sectional view taken along a line II—II in FIG. 1.
Figure 3:
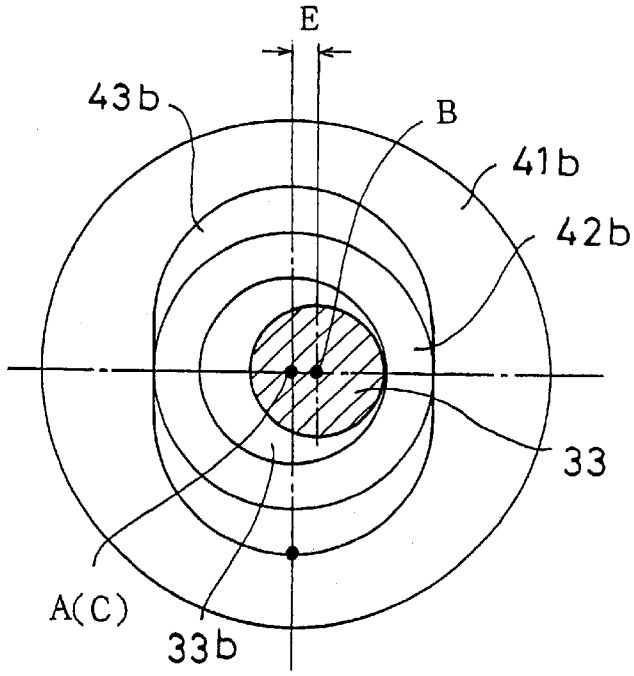
FIG. 3 is a sectional view taken along a line III—III in FIG. 1.

FIG. 1 is a, vertical sectional view of a hermetic compressor according to an embodiment of the present invention; FIG. 2 is a sectional view taken along a line II—II in FIG. 1; FIG. 3 is a sectional view taken along a line III—III in FIG. 1; and FIGS. 4*a* to 4*h* are views for explaining the movement of a compressor mechanism section in the embodiment.

Referring to FIG. 1, a hermetic compressor according to the embodiment includes a motor 30 and a compressor mechanism section 40 within a shell 10 constituting a hermetic container.

The shell 10 has a discharge pipe 11 at its upper portion, and two intake pipes 12*a* and 12*b* at a side of its lower portion.

The motor 30 comprises a stator 31 fixed to the shell 10, and a rotor 32 which is rotated. The rotation of the rotor 32, is transmitted to the compressor mechanism section 40 by a shaft 33.

The compressor mechanism section 40 includes a first compressing mechanism 40*a* comprising a first rotary cylinder 41*a* and a first piston 42*a*, and a second compressing mechanism 40*b* comprising a second rotary cylinder 41*b* and a second piston 42*b*. The first rotary cylinder 41*a* has an elliptic groove 43*a*, and the second rotary cylinder 41*b* has an elliptic groove 43*b*. The first piston 42*a* is slidably provided in the groove 43*a*, and the second piston 42*b* is slidably provided in the groove 43*b*. The members constituting the first and second compressing mechanisms 40*a* and 40*b* are of the same size and shape.

The first and second compressing mechanisms 40*a* and 40*b* are partitioned from each other by a partition plate 44. As will be described in detail hereinafter, the first rotary cylinder 41*a*, the second rotary cylinder 41*b* and the partition plate 44 are connected together and moved in unison with one another. However, the first and second rotary cylinders 41*a* and 41*b* are connected to each other with the grooves 43*a* and 43*b* offset from each other at 90 degree, so that the phases of compressing strokes are different at 180 degree from each other.

On the other hand, the first and second pistons 42*a* and 42*b* are fitted over first and second cranks 33*a* and 33*b*, respectively. The first and second cranks 33*a* and 33*b* are provided so that their eccentric directions are different at 180 degree from each other.

The first and second compressing mechanisms 40*a* and 40*b* are sandwiched from above and below by an upper bearing 50*a* and a lower bearing 50*b* and surrounded by a tubular casing 51.

The upper bearing 50*a* is provided with an intake port 51*a* and a discharge port 52*a* for the first compressing mechanism 40*a*, and the lower bearing 50*b* is provided with an intake port 51*b* and a discharge port 52*b* for the second compressing mechanism 40*b*. The positions of disposition of the intake ports 51*a* and 51*b* and the discharge ports 52*a* and 52*b* will be described hereinafter. Provided in the discharge ports 52*a* and 52*b* are valves 53*a* and 53*b* which are opened by a predetermined pressure, and valve stops 54*a* and 54*b* for limiting the opening movements of the valves 53*a* and 53*b*. The intake port 51*a* communicates with the intake pipe 12*a*, and the intake port 51*b* communicates with the intake pipe 12*b*. The intake pipes 12*a* and 12*b* are connected to an accumulator 60.

The flow of a refrigerant in the hermetic compressor having the above-described arrangement will be described below in brief.

The gas refrigerant within the accumulator 60 is introduced through the intake pipes 12*a* and 12*b* into the shell 10 and drawn through the intake port 51*a* and 51*b* into the first and second compressing mechanisms 40*a* and 40*b*. When the refrigerant compressed in the first and second compressing mechanisms 40*a* and 40*b* reaches a predetermined pressure, it pushes up the valves 53*a* and 53*b* and is discharged through the discharge ports 52*a* and 52*b* into the shell 10. In this case, the discharging timings in the first and second compressing mechanisms 40*a* and 40*b* are not the same as each other, because the phases are different at 180 degree from each other. The refrigerant discharged into the shell 10 is passed through an area around the motor 30 and discharged to the outside of the shell 10 through the discharge pipe 11 provided at the upper portion of the shell 10.

The relationship between the shaft 33, the pistons 42*a* and 42*b* and the rotary cylinders 41*a* and 41*b* in the first and second compressing mechanisms 40*a* and 40*b* will be described below with reference to FIGS. 2 and 3.

The shaft 33 adapted to transmit the rotation of the motor 30 is rotated about a point B. The center C of the cranks 33*a* and 33*b* provided on the shaft 33 is eccentric by a distance E from the center B of rotation of the shaft 33. The center C of the cranks 33*a* and 33*b* is also the center of rotation of the pistons 42*a* and 42*b*. Namely, the pistons 42*a* and 42*b* perform a rotating movement about the center C of the cranks 33*a* and 33*b*. On the other hand, the rotary cylinders 41*a* and 41*b* have the center of rotation provided by a position spaced apart at the distance E from the center B of rotation of the shaft 33. Therefore, when the center C of the cranks 33*a* or the piston 42*a* is spaced to the maximum apart from the center A of rotation of the rotary cylinder 41*a*, the largest and smallest spaces are formed in the groove by the piston 42*a*, as shown in FIG. 2. The second compressing mechanism 40*b* has a phase difference of 180 degree from the phase of the first compressing mechanism 40*a* and hence, when the first compressing mechanism 40*a* is in a state shown in FIG. 2, the center C of rotation of the crank 33*b* or the piston 42*b* in the second compressing mechanism 40*b* overlaps the center A of rotation of the rotary cylinder 41*b*, as shown in FIG. 3. Therefore, the space section in the groove 43*b* is divided into two equal spaces by the piston 42*b*, as shown in FIG. 3. The spaces defined in the groove 43*a* in the rotary cylinder 41*a* by the piston 42*a* and the spaces defined in the groove 43*b* in the rotary cylinder 41*b* by the piston 42*b* are called "compressive spaces" hereinafter.

Figure 4:
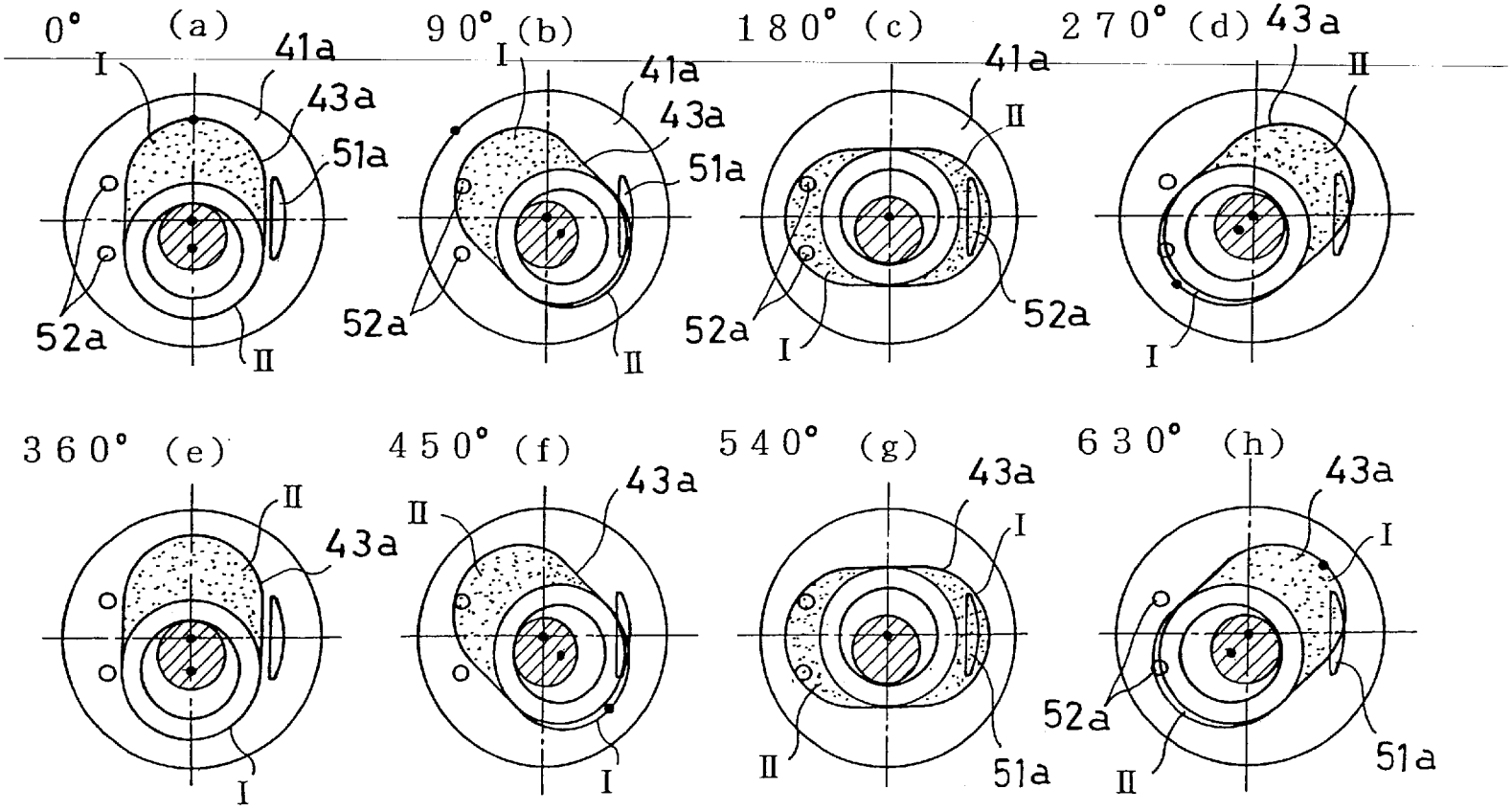

The refrigerant gas sucking and compressing strokes will be described below with reference to FIG. 4. The sucking and compressing strokes in the first compressing mechanism 40*a* will be described, but the second compressing mechanism 40*b* provides the same strokes, except that the phase in FIG. 4 is different by 180 degree from that in the first compressing mechanism 40*a*.

FIGS. 4*a* to 4*h* show states in which the shaft 33 has been rotated through every 90 degree, respectively.

When the shaft 33 is not rotated as shown in FIG. 4*a*, the groove 43*a* is in a state in which the one of the compressive space I is largest, and the other compressive space II is smallest.

The volume of the one compressive space I is gradually decreased from the state shown in FIG. 4*b* in which the shaft 33 has been rotated through 90 degree via the state shown in FIG. 4*c* in which the shaft 33 has been rotated through 180 degree to the state shown in FIG. 4*d* in which the shaft 33 has been rotated through 270 degree, whereby the compressed refrigerant is discharged from the discharge port 52*a*. In the compressive space I, the compressing stroke is finished in the state shown in FIG. 4*e* in which the shaft 33 has been rotated through 360 degree.

The volume of the other compressive space II is gradually increased from the state shown in FIG. 4*b* in which the shaft 33 has been rotated through 90 degree via the state shown in FIG. 4*c* in which the shaft 33 has been rotated through 180 degree to the state shown in FIG. 4*d* in which the shaft 33 has been rotated through 270 degree, whereby the compressed refrigerant is sucked from the intake port 52*a*. In the compressive space II, the sucking stroke is finished in the state shown in FIG. 4*e* in which the shaft 33 has been rotated through 360 degree.

In the states shown in FIG. 4*e* to FIG. 4*h*, the sucking stroke is carried out in the one compressive space I, and the compressing stroke is carried out in the other compressing space II. When the shaft 33 is further rotated through 90 degree from the state shown in FIG. 4*h*, the state shown in FIG. 4*a* is obtained.

In this way, the compressing and sucking strokes are carried out in the two compressive spaces I and II defined in the groove 43*a*, respectively, while the shaft 33 is rotated through 720 degree.

With respect to the positions for disposition of the intake ports 51*a* and 51*b* and the discharge ports 52*a* and 52*b*, the intake port 51*a* and the intake port 51*b* as well as the discharge port 52*a* and the discharge port 52*b* are disposed in an axially opposed relation to each other. The intake port 51*a* and the discharge port 52*a* defined in the upper bearing 50*a* will be described representatively with reference to FIG. 4*a*. The intake port 51*a* and the discharge port 52*a* are located to lie inside the locus of rotation of the end edge of the groove 43*a* and sideways of the elliptic groove 43*a*. More specifically, the intake port 51*a* has a crescent shape (see FIGS. 4*a* and 4*e* showing the states of the shaft which is not rotated and has been rotated through 360 degree) having an inner edge extending one of side edges of the groove 43*a* when the compressive spaces I and II assume the largest or smallest volume. When the shaft is not rotated and has been rotated through 360 degree, the crescent-shaped intake port 51*a* does not communicate with both the compressive spaces I and II, and when the shaft 33 assumes a position of another angle, the crescent-shaped intake port 51*a* continuously communicates with the compressive space I or II, whereby an end edge of the crescent-shaped intake port 51*a* at a suction starting point and a suction completing point is formed to suck the refrigerant gas. Namely, the suction starting point and a suction completing point of the crescent-shaped intake port 51*a* are set at locations slightly offset from the groove 43*a*, when the compressive space I or II assume the largest or smallest volume. The outer edge of the crescent-shaped intake port 51*a* is set into an arc extending in substantial conformity to the locus of movement and along the locus of movement of the end edge of the groove 43*a* at an intermediate stroke between the suction starting point and the suction completing point.

Similarly, when the shaft 33 is not rotated and has been rotated through 360 degree in which the compressive spaces I and II assume the smallest or largest volume, the discharge port 52*a* is constituted of a pair of circular port portions disposed at a distance along the other side edge of the groove 43*a*, so that it does not communicate with both the compressive spaces I and II. The pair of discharge port portions 52*a* and the crescent-shaped intake port 51*a* are disposed so that they do not communicate with each other through the compressive space I or II at locations of all rotational angles of the shaft 33.

According to the embodiment, even if the piston is located at the center of the rotary cylinder in one of the compressing mechanisms, it can be avoided that the driving force from the piston does not serve as a rotating force for the rotary cylinder, because the other compressing mechanism provides a rotating force. In addition, the pistons can be disposed symmetrically by ensuring that the phase difference between the two compressing mechanisms is 180 degree, whereby the production of the hermetic compressor can be carried out easily. The freedom degree of setting of the positions of the intake port and the discharge port is increased by providing intake port and the discharge port in the upper and lower bearing, respectively. Therefore, it is possible to regulate the compression ratio and to prevent the over-compression by the positions of the intake port and the discharge port. Further, since the phases of the first and second compressing mechanisms are different from each other by 180 degree, and the intake port in the upper bearing and the intake port in the lower bearing are provided on the same axis, the position of mounting of the intake pipe can be the same side, and a piping cannot be drawn around for connection of the intake pipe to the accumulator or the like.

The shapes and positions of the intake port 51*a* (51*b*) and the discharge port 52*a* (52*b*) are determined, so that they do not simultaneously communicate with one of the compressive spaces at any rotational angle of the shaft 33. Therefore, during compression, the high-pressure refrigerant gas is leaked toward the intake side through the compressive space and hence, a high suction efficiency (volume efficiency) can be realized. Further, the intake port 51*a* (51*b*) is set into a shape such that it does not face the compressive space at the suction starting point and the suction completing point, leading to a construction in which the intake port 51*a* (51*b*) is reliably cut away from the compressing stroke in the compressive space. As a result, the refrigerant gas cannot be leaked toward the intake side during compression and hence, the high suction efficiency can be realized. In addition, the intake port 51*a* (51*b*) communicates with the compressive space at all the suction stroke excluding the suction starting point and the suction completing point by virtue of the shape of the crescent-shaped intake port 51*a* (51*b*) and hence, when the volume of the compressive space is increased, the refrigerant gas is drawn or sucked from the intake port 51*a* (51*b*) with a small pressure loss and consequently, the high suction efficiency can be realized.

In addition, since the outer edge of the crescent-shaped intake port 51*a* (51*b*) is set into the arc extending in substantial conformity to the locus of movement and along the locus of movement of the end edge of the groove 43*a* (43*b*) at the intermediate stroke between the suction starting point and the suction completing point, an affective suction efficiency can be realized by the crescent-shaped intake port 51*a* (51*b*) free from any sufficiency and shortage. On the other hand, the pair of discharge ports 52*a* (52*b*) including the discharge valve mechanisms 53 and 54 are provided at locations where they do not communicate with the compressive space at a compression starting point and a compression completing point and hence, a phenomenon of leakage of the refrigerant gas in the high-pressure space to the compressive space is not produced. In addition, the refrigerant gas in the compressive space is discharged via the plurality of discharge ports into the high-pressure space with advancing of the compressing stroke while permitting the compressive space to be rotated. Therefore, a phenomenon of over-compression cannot be produced and as a result, a high compressing efficiency can be realized.

FIGS. 5 to 7 show a first assembly 110 comprised of the first and second rotary cylinders 41*a* and 41*b* and the partition plate 44. FIG. 5 is a side view of the assembly 110 as viewed from the side of the first rotary cylinder 41*a*; FIG. 6 is a vertical sectional view of the assembly; and FIG. 7 is a side view of the assembly as viewed from the side of the second rotary cylinder 41*b*. A one-dot dashed line 111 in FIG. 5 indicates a locus of rotation of the groove 43*a* with the rotation of the first rotary cylinder 41*a*, namely, a circumcircle of the groove 43*a*. Four bolt insertion bores 112 and 113 circumferentially spaced at equal distances apart from one another are defined respectively in the first rotary cylinder 41*a* and the partition plate 44 around the outer periphery of the locus of rotation (see FIG. 6). Each of the bolt insertion bores 112 has a larger-diameter portion 112*a* for receiving ahead of a fastening bolt 114 at a location adjacent the outer surface of the first rotary cylinder 41*a*. Four threaded bores 115 are defined through the second cylinder 41*b* at locations corresponding to the bolt insertion bores 112 in the first rotary cylinder 41*a*, as shown in FIG. 7.

The first assembly 110 is produced by disposing between the second rotary cylinders 41*a* and 41*b* and then inserting the fastening bolt 114 from the side of the first rotary cylinder 41*a* into the second rotary cylinder 41*b* to threadedly engage the bolt 114 into the threaded bore 115 in the second rotary cylinder 41*b*. With respect to the positions for disposition of the intake ports 51*a* and 51*b* and the discharge ports 52*a* and 52*b*, those of the intake port 51*a* and the discharge port 52*a* will be described representatively. The intake port 51*a* and the discharge port 52*a* are located to lie inside the locus 111 of rotation of the groove 43*a* and sideways of the elliptic groove 43*a*.

The first assembly 110 is of a construction made by disposing the partition plate 44 between the first and second rotary cylinders 41*a* and 41*b*, and connecting the first and second rotary cylinders 41*a* and 41*b* to each other by the fastening bolt 114 in a state in which the partition plate 44 has been sandwiched between the first and second rotary cylinders 41*a* and 41*b*. Therefore, when each of the rotary cylinders 41*a* and 41*b* are to be made, they can be machined separately. Namely, each of the first and second rotary cylinders 41*a* and 41*b* is of a simple configuration in which the elliptic groove 43*a*, 43*b* is merely provided at a central portion of a disk. To form the rotary cylinders 41*a* and 41*b*, the grooves 43*a* and 43*b* can be machined with a good accuracy and easily by cutting or the like and hence, the cost for producing the rotary cylinders 41*a* and 41*b* can be reduced.

Since the first rotary cylinder 41*a* is provided with the larger-diameter portion 112*a* for receiving the head 114*a* of the fastening bolt 114, the head 114*a* of the fastening bolt 114 cannot protrude from the first assembly 110. Therefore, it is not required that a groove for avoiding the interference with the bolt head 114*a* is made by machining in the upper bearing 50*a* facing the bolt head 114*a*, whereby the cost due to the machining of the upper bearing 50*a* can be reduced. The bolt insertion bores 112 and the threaded bore 115 made through the first and second rotary cylinders 41*a* and 41*b* are disposed at locations where they cannot face the intake ports 51*a* and 51*b* and the discharge ports 52*a* and 52*b*. Therefore, the insertion bores 52*a* and 52*b* and the threaded bore 115 cannot be aligned with the intake ports 51*a* and 51*b* and the discharge ports 52*a* and 52*b* with rotation of the first and second rotary cylinders 41*a* and 41*b*. Thus, a lower-pressure gas or a higher-pressure gas cannot flow into the insertion bores 52*a* and 52*b* and the threaded bore 115 upon every rotation of the rotary cylinder and hence, it is possible to prevent a reduction in efficiency due to the flowing of the gas into the bores 112 and 115.

In place of the threaded bore 115 defined in the second rotary cylinder 41*b*, a bolt insertion bore may be made in the second rotary cylinder 41*b*, and a larger-diameter portion for receiving a nut adapted to be threadedly engaged with the fastening bolt 114 may be provided in the bolt insertion bore.

FIGS. 8 to 10 shows a second assembly 120 comprised of first and second rotary cylinders 41*a* and 41*b* and a partition plate 44. FIG. 8 is a side view of the assembly 120 as viewed from the side of the first rotary cylinder 41*a*; FIG. 9 is a vertical sectional view of the assembly 120; and FIG. 10 is a side view of the assembly as viewed from the side of the second rotary cylinder 41*b*. The second assembly 120 corresponds to a modification to the first assembly 110. As can be understood from FIG. 8, the positions for disposition of the intake port 51*a* and the discharge port 52*a* are similar to those in the first assembly 110. However, in place of the bolt insertion bores 112 and 113 and the threaded bore 115 in the first assembly 110, pin insertion bores 121, 122 and 123 are defined in corresponding elements 41*a*, 44 and 41*b*, respectively, and the first and second rotary cylinders 41*a* and 41*b* located with the partition plate 44 interposed therebetween are integrally connected together by inserting a pin 124 through the pin insertion bores 121, 122 and 123.

With the second assembly 120, when the rotary cylinders 41*a* and 41*b* are to be produced, they can be machined separately, as in the first assembly 110. To form the rotary cylinders 41*a* and 41*b*, grooves 43*a* and 43*b* can be made by machining such as cutting with a good accuracy and easily. The pin insertion bores 121 and 123 made through the first and second rotary cylinders 41*a* and 41*b* are disposed at locations where they cannot face the intake ports 51*a* and 51*b* and the discharge ports 52*a* and 52*b*. Therefore, the pin insertion bores 121 and 123 cannot be aligned with the intake ports 51*a* and 51*b* and the discharge ports 52*a* and 52*b* with rotation of the first and second rotary cylinders 41*a* and 41*b*. Thus, it is possible to prevent a reduction in efficiency due to the flowing of a gas into the bores 121 and 123.

FIGS. 11 and 12 show a third assembly 130 comprised of first and second rotary cylinders 41*a* and 41*b* and a partition plate 44. FIG. 11 is a side view of the third assembly as viewed from the side of the first rotary cylinder 41*a*; and FIG. 12 is a vertical sectional view of the third assembly. In the third assembly 130, four bottomed pin receiving bores 131*a* and 131*b* circumferentially spaced at equal distances apart from one another are defined respectively in opposed inner surfaces of the first and second rotary cylinders 41*a* and 41*b* (not shown in FIG. 9) around the outer periphery of the locus 111 of rotation. Pin insertion bores 132 are defined in the partition plate 44 at locations corresponding to the pin receiving bores 131*a* and 131*b*.

The third assembly 130 is made by superposing the first or second rotary cylinder 41*a* or 41*b* and the partition plate 44 one onto another, inserting a pin 133 into each of the bores, and superposing the remaining first or second rotary cylinder 41*a* or 41*b*. In the third assembly 130, the relative rotation of the first and second rotary cylinders 41*a* and 41*b* located with the partition plate sandwiched therebetween is prohibited.

With the third assembly 130, when the rotary cylinders 41*a* and 41*b* are to be produced, they can be machined separately, as in the first and second assemblies 110 and 120. Therefore, to form the rotary cylinders 41*a* and 41*b*, grooves 43*a* and 43*b* can be made with a good accuracy and easily by machining such as cutting. Since the bores 131*a* and 131*b* for receiving the pins 133 provided in the first and second rotary cylinders 41*a* and 41*b* are bottomed, a gas cannot flow into and out of the intake ports 51*a* and 51*b* and the discharge ports 52*a* and 52*b* through the pin receiving bores 131*a* and 131*b*. This provides an increased degree of freedom in design concerning the positions for disposition of and the sizes of the intake ports 51*a* and 51*b* and the discharge ports 52*a* and 52*b*. As a result, it is possible to select a port shape in which intake and discharge losses are small, and from this viewpoint, it is possible to enhance the efficiency of the compressor.

FIG. 13 is an exploded perspective view of a fourth assembly 140 comprised of first and second rotary cylinders 41*a* and 41*b* and a partition plate 44. In the fourth assembly 140, recesses and projections are formed on opposed surface of the first rotary cylinder 41*a* and the partition plate 44 and opposed surfaces of the second rotary cylinder 41*b* and the partition plate 44, so that the relative rotation of the elements is prohibited by fitting of the projections and recesses with each other. More specifically, two recesses 131 are formed at a distance of 180° in diametrical portions of the first rotary cylinder 41*a*, and two projections 132 corresponding to the recesses are formed on the partition plate 44. In addition, two recesses 133 are formed at a distance of 180° in diametrical portions of the second rotary cylinder 41*b*, and two projections 134 corresponding to the recesses are formed on the partition plate 44. Alternatively, a recess may be provided in each of the first and second rotary cylinders 41*a* and 41*b*, and a recess may be provided in the partition plate 44.

With the fourth assembly 140, the two rotary cylinders 41*a* and 41*b* can be separated from each other, while limiting the relative angle of the first and second rotary cylinders 41*a* and 41*b* by recess-protrusion fitting of the first and second rotary cylinders 41*a* and 41*b* with the partition plate 44. Therefore, a gas force applied to one of the rotary cylinders is not transmitted to the other rotary cylinder and as a result, the rotary cylinders 41*a* and 41*b* cannot be inclined together during rotation of the fourth assembly. Thus, it is possible to prevent the partial abutment of the rotary cylinders 41*a* and 41*b* against the upper and lower bearings 50*a* and 50*b* to reduce the sliding wear of outer peripheral portions of the rotary cylinders 41*a* and 41*b*.

FIGS. 14 to 16 show a fifth assembly comprised of first and second rotary cylinders 41*a* and 41*b* and a partition plate 44. FIG. 14 is a side view of the assembly 150 as viewed from the side of the first rotary cylinder 41*a*; FIG. 15 is a vertical sectional view of the assembly 150; and FIG. 16 is a side view of the assembly 150 as viewed from the side of the second rotary cylinder 41*b*. Reference character 151 in FIG. 15 indicates a weld zone. As can be understood from FIG. 15, the first and second rotary cylinders 41*a* and 41*b* and the partition plate 44 are integrally connected together by welding. In this case, as can be seen from FIG. 15, the partition plate 44 may have a diameter considerably smaller than those of the first and second rotary cylinders 41*a* and 41*b*, or may have a diameter substantially equal to those of the first and second rotary cylinders 41*a* and 41*b*.

With the fifth assembly 150, when the rotary cylinders 41*a* and 41*b* are to be produced, they can be machined separately, as in the first and second assemblies 110 and 120, and to form the rotary cylinders 41*a* and 41*b*, grooves 43*a* can be made with a good accuracy and easily by machining such as cutting. When the diameter of the partition plate 44 is considerably smaller than those of the first and second rotary cylinders 41*a* and 41*b*, the area of contact between the outer peripheral portion of the partition plate 44 and the first and second rotary cylinders 41*a* and 41*b* can be increased, and hence, they can be fixed with a higher strength at a small number of welded points.

FIGS. 17 to 19 show a sixth assembly 160 comprised of first and second rotary cylinders 41*a* and 41*b* and a partition plate 44. FIG. 17 is a side view of the assembly 160 as viewed from the side of the first rotary cylinder 41*a*; FIG. 18 is a vertical sectional view of the assembly 160; and FIG. 19 is a side view of the assembly 160 as viewed from the side of the second rotary cylinder 41*b*. As can be understood from FIG. 18, the first and second rotary cylinders 41*a* and 41*b* and the partition plate 44 are formed integrally with each other.

With the sixth assembly 160, a means for mechanically fastening the two first and second rotary cylinders 41*a* and 41*b*, e.g., a member such as a bolt and a pin, is not required, and a means such as recess-projection fitting for limiting the relative rotation between the first and second rotary cylinders 41*a* and 41*b* is not required. It is unnecessary to define through-bores in the rotary cylinders, as in the first and second assemblies 110 and 120 and hence, the flowing-out of a gas through the through-bores cannot be produced. This provides an increased degree of freedom in design concerning the positions for disposition of and the sizes of the intake ports 51*a* and the discharge ports 52*a* and 52*b*. As a result, it is possible to select a port shape in which intake and discharge losses are small, and from this viewpoint, it is possible to enhance the efficiency of the compressor.

The phase difference between the two compressing mechanisms is 180 degree in the embodiment, but is not limited to this angle and may be 90 degree, 270 degree or any angle other than these angles. The embodiment has been described as being provided with the two compressing mechanisms, but three or more compressing mechanisms may be provided.

Figure 23:
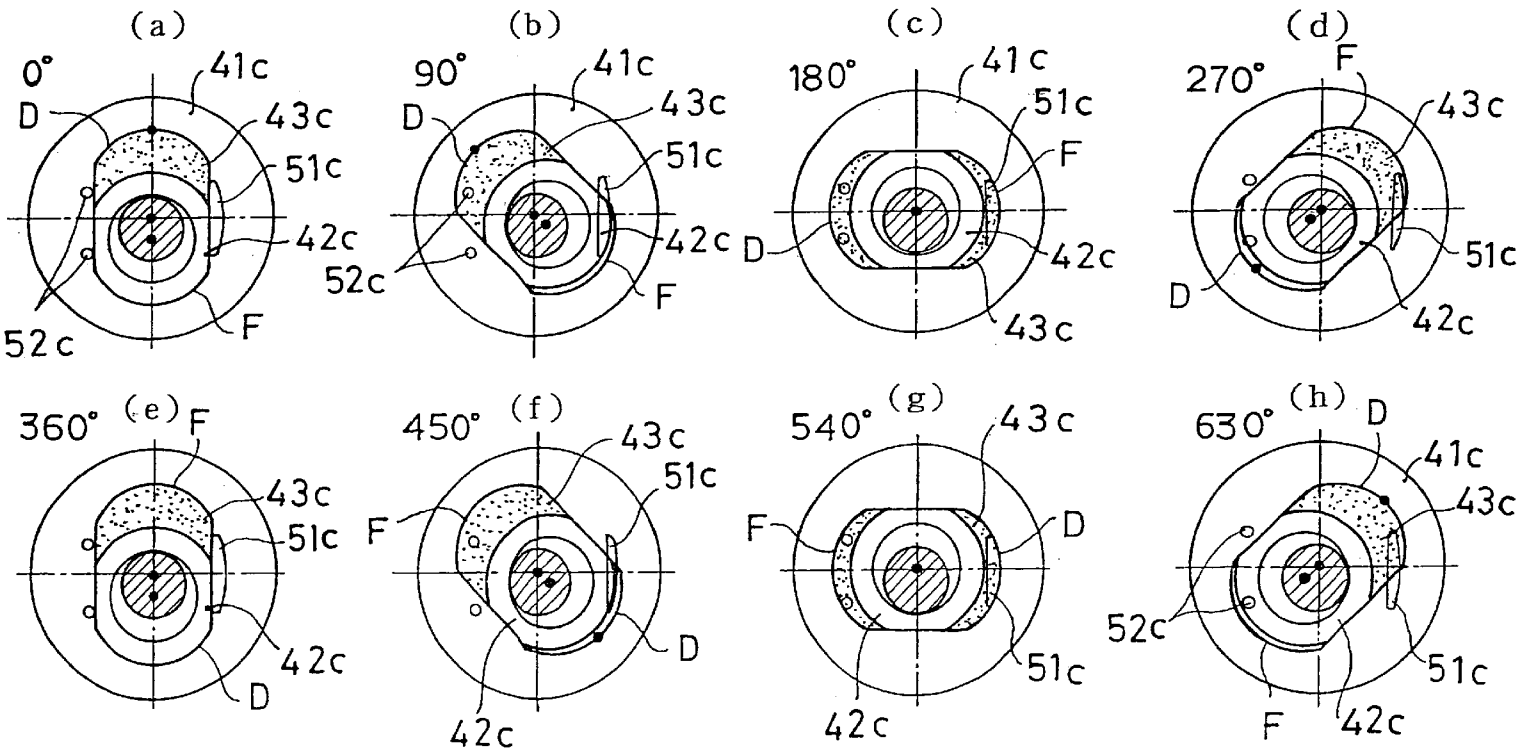

Another embodiment of a compressor according to the present invention will now be described with reference to the drawings. FIG. 20 is a vertical sectional view of a hermetic compressor having first and second compressing mechanisms according to the present embodiment; FIG. 21 is a sectional view taken along a line II—II in FIG. 20; FIG. 22 is a sectional view taken along a line III—III in FIG. 20; and FIG. 23 is a view for explaining the operation of the compressing mechanism in this embodiment.

In FIGS. 20 to 23, members or portions having the same function as those in the embodiment shown in FIGS. 1 to 4 are designated by like reference characters.

As shown in FIG. 20, a hermetic compressor in this embodiment includes a motor 30 and a compressor mechanism section 40 within a shell 10 constituting a hermetic container.

The shell 10 includes a discharge pipe 11 at its upper portion, and two intake pipes 12*c* and 12*d* on a side of its lower portion.

The motor 30 comprises a stator 31 fixed to the shell 10, and a rotor 32 which is rotated. The rotation of the rotor 32 is transmitted to the compressor mechanism section 40 by a shaft 33.

The compressor mechanism section 40 includes a first compressing mechanism 40*c* comprised of a first rotary cylinder 41*c* and a first piston 42*c*, and a second compressing mechanism 40*d* comprised of a second rotary cylinder 41*d* and a second piston 42*d*. The first rotary cylinder 41*c* has a first groove 43*c*, and the second rotary cylinder 41*d* has a second groove 43*d*. The first piston 42*c* is slidably provided in the first groove 43*c*, and the second piston 42*d* is slidably provided in the second groove 43*d*. The members constituting the first and second compressing mechanisms 40*c* and 40*d* are of the same size and shape.

As shown in FIGS. 21 and 22, each of the first and second pistons 42*c* and 42*d* is formed by cutting a cylindrical member in parallel, so that the contour of its section is comprised of two arcs 70, 70 and two parallel straight lines 71, 71 having a length a. Namely, flat faces 72, 72 having the length a are formed in areas provided by the straight lines 71, 71. On the other hand, each of the first and second grooves 43*c* and 43*d* in the first and second rotary cylinders 41*c* and 41*d* having the first and second pistons 42*c* and 42*d* slidably retained therein is formed by arcs 73, 73 having the substantially same shape as the arcs 70, 70, and two parallel straight lines 74, 74 having a length 4 E+a. Namely, flat faces 75, 75 having the length 4 E+a are formed in areas provided by the straight lines 74, 74.

As shown in FIGS. 21 and 22, the first and second pistons 42*c* and 42*d* having the above-described shape are slidably retained in the first and second grooves 43*c* and 43*d* with their flat faces 72, 72 being in abutment against the flat faces 75, 75 of the first and second grooves 43*c* and 43*d* in the first and second rotary cylinders 41*c* and 42*d*, respectively. The first and second pistons 42*c* and 42*d* are slid within the grooves 43*c* and 43*d* while being maintained in such retained states, respectively.

As shown in FIG. 20, the first and second compressing mechanisms 40*c* and 40*d* are partitioned from each other by the partition plate 44. The first rotary cylinder 41*c*, the second rotary cylinder 41*d* and the partition plate 44 are connected together and moved in the same manner. However, the first and second rotary cylinders 41*c* and 41*d* are connected to each other with the first and second grooves 43*c* and 43*d* offset at 90 degree from each other, so that the phases in the compressing strokes are different by 180 degree from each other.

On the other hand, the first and second pistons 42*c* and 42*d* are fitted over first and second cranks 33*c* and 33*d* provided on the shaft 33. The first and second cranks 33*c* and 33*d* are provided so that their eccentric directions are different by 180 degree from each other.

The first and second compressing mechanisms 40*c* and 40*d* are sandwiched from above and below by an upper bearing 50*c* and a lower bearing 50*d* and surrounded by a tubular casing 51.

The upper bearing 50*c* is provided with an intake port 51*c* and a discharge port 52*c* for the first compressing mechanism 40*c*, and the lower bearing 50*d* is provided with an intake port 51*d* and a discharge port 52*d* for the second compressing mechanism 40*d*. Provided in the discharge ports 52*c* and 52*d* are valves 53*c* and 53*d* which are opened by a predetermined pressure, and valve stops 54*c* and 54*d* for limiting the opening movements of the valves 53*c* and 53*d*. The intake port 51*c* communicates with the intake pipe 12*c*, and the intake port 51*d* communicates with the intake pipe 12*d*. The intake pipes 12*c* and 12*d* are connected to an accumulator 60.

The flow of a refrigerant in the hermetic compressor having the above-described arrangement will be described below in brief.

The gas refrigerant in the accumulator 60 is introduced into the shell 10 through the intake pipes 12*c* and 12*d*. The refrigerant passed through the intake ports 51*c* and 52*d* and compressed in the first and second compressing mechanisms 40*c* and 40*d*, when it reaches a predetermined pressure, pushes up the valves, and is then discharged through the discharge ports 52*c* and 52*d* into the shell 10. At this time, the discharging timings are not the same as each other, because the first and second compressing mechanisms 40*c* and 40*d* are different in their phases by 180 degree from each other. The refrigerant discharged into the shell is passed through an area around the motor 30 and discharged to the outside of the shell 10 through the discharge pipe 11 mounted at the upper portion of the shell 10.

The relationship between the shaft 33, the first and second pistons 42*c* and 42*d* and the first and second rotary cylinders 41*c* and 41*d* in the first and second compressing mechanisms 40*c* and 40*d* will be described below with reference to FIGS. 21 and 22.

The shaft 33 adapted to transmit the rotation of the motor 30 is rotated about a point B. The center C of the cranks 33*c* and 33*d* provided on the shaft 33 is eccentric by a distance E from the center B of rotation of the shaft 33. The center C of the cranks 33*c* and 33*d* is also the center of rotation of the pistons 42*c* and 42*d*. On the other hand, the rotary cylinders 41*c* and 41*d* have the center of rotation provided by a position spaced apart at the distance E from the center B of rotation of the shaft 33. Therefore, when the center C of the cranks 33*c* or the piston 42*c* is spaced to the maximum apart from the center A of rotation of the rotary cylinder 41*c*, the largest and smallest spaces are formed in the groove 43*c*, as shown in FIG. 21. The second compressing mechanism 40*d* has a phase difference of 180 degree from the phase of the first compressing mechanism 40*c* and hence, when the first compressing mechanism 40*c* is in a state shown in FIG. 21, the center C of rotation of the crank 33*d* or the piston 42*d* in the second compressing mechanism 40*d* overlaps the center A of rotation of the rotary cylinder 41*d*, as shown in FIG. 22. Therefore, the space section in the groove 43*b* is divided into two equal spaces, as shown in FIG. 3.

The refrigerant gas sucking and compressing strokes will be described below with reference to FIG. 23, but the second compressing mechanism 40*b* provides the same strokes, except that the phase in FIG. 4 is different by 180 degree from that in the first compressing mechanism 40*a*.

FIGS. 23*a* to 23*h* show states in which the shaft 33 has been rotated through every 90 degree, respectively.

When the shaft 33 is not rotated as shown in FIG. 23*a*, the first groove 43*c* is in a state in which the one of the space D is largest, and the space F is smallest.

The volume of the space D is gradually decreased from the state shown in FIG. 23*b* in which the shaft 33 has been rotated through 90 degree via the state shown in FIG. 23*c* in which the shaft 33 has been rotated through 180 degree to the state shown in FIG. 23*d* in which the shaft 33 has been rotated through 270 degree, whereby the compressed refrigerant is discharged from the discharge port 52*c*. In the space D, the compressing stroke is finished in the state shown in FIG. 23*e* in which the shaft 33 has been rotated through 360 degree.

On the other hand, the volume of the space F is gradually increased from the state shown in FIG. 23*b* in which the shaft 33 has been rotated through 90 degree via the state shown in FIG. 23*c* in which the shaft 33 has been rotated through 180 degree to the state shown in FIG. 23*d* in which the shaft 33 has been rotated through 270 degree, whereby the compressed refrigerant is sucked from the intake port 51*c*. In the space F, the sucking stroke is finished in the state shown in FIG. 23*e* in which the shaft 33 has been rotated through 360 degree.

In the states shown in FIG. 23*e* to FIG. 23*h*, the sucking stroke is carried out in the space D, and the compressing stroke is carried out in the space F. When the shaft 33 is further rotated through 90 degree from the state shown in FIG. 23*h*, the state shown in FIG. 23*a* is obtained.

In this way, the compressing and sucking strokes are carried out in the two spaces D and F defined in the first groove 43*c*, respectively, whenever the shaft 33 is rotated through 720 degree.

According to this embodiment, even if the piston is located at the center of the cylinder, it can be avoided that the driving force from the piston does not serve as a rotating force for the rotary cylinder, because the other compressing mechanism provides a rotating force. In addition, the pistons can be disposed symmetrically by ensuring that the phase difference between the two compressing mechanisms is 180 degree, whereby the production of the hermetic compressor can be carried out easily. The freedom degree of setting of the positions of the intake port and the discharge port is increased by providing intake port and the discharge port in the upper and lower bearing, respectively. Therefore, it is possible to regulate the compression ratio and to prevent the over-compression by the positions of the intake port and the discharge port. Further, since the phases of the first and second compressing mechanisms are different from each other by 180 degree, and the intake port in the upper bearing and the intake port in the lower bearing are provided on the same axis, the position of mounting of the intake pipe can be the same side, and a piping cannot be drawn around for connection of the intake pipe to the accumulator or the like.

The phase difference between the two compressing mechanisms is 180 degree in the embodiment, but is not limited to this angle and may be 90 degree, 270 degree or any angle other than these angles.

The embodiment has been described as being provided with the two compressing mechanisms, but three or more compressing mechanisms may be provided.

FIGS. 24 and 25 show a second embodiment of a compressor mechanism section according to the present invention. In this embodiment, the structure of the compressor mechanism section is only different from that in the first embodiment, and the structures of the other components are the same as those in the first embodiment and hence, the duplicated description thereof is omitted. FIG. 24 shows a first compressing mechanism 40*e*, and FIG. 25 shows a second compressing mechanism 40*f*. The phases of the first and second compressing mechanisms 40*e* and 40*f* in the compressing stroke are different from each other by 180 degree.

The first compressing mechanism 40*e* in the present embodiment comprises a first rotary cylinder 41*e* and a first piston 42*e*, and the second compressing mechanism 40*f* comprises a second rotary cylinder 41*f* and a second piston 42*f*. First and second grooves 43*c* and 43*f* are defined in the first and second rotary cylinders 40*e* and 40*f*, respectively. The first and second compressing mechanisms 40*e* and 40*f* are of the same structure, and hence, only the structure of the first compressing mechanism will be described, and the duplicated description is omitted.

The first piston 42*e* is formed, so that the contour of its section is comprised of two arcs 70', 70' and two parallel straight lines 71', 71' having a length a. Namely, flat faces 72', 72' having the length a are formed in areas provided by the straight lines 71', 71'.

On the other hand, the first groove 43*e* in the first rotary cylinder 41*e* is formed by arcs 73', 73' having the substantially same shape as the arcs 70', 70' of the first piston 42*e*, and two parallel straight lines 74', 74' having a length 4 E+a. Namely, flat faces 75', 75' having the length 4 E+a are formed in areas provided by the straight lines 74', 74'.

The first piston 42*e* having the above-described structure is of a shape in which the semi-circular arcs 70', 70' are connected to each other by the two straight lines 71', 71', as described above and hence, any corner is not produced at such connection area. The first piston 42*e* is slid within the first groove 43*e* with its flat faces 72', 72' being in abutment against the flat faces 75', 75' of the first groove 43*e*. In this case, the smooth sliding movement is carried out, because any corner is not present in the first piston 40*e*, as described above. In addition, the flat faces 72', 72' and the flat faces 75', 75' are in close contact with each other and hence, the sealability can be enhanced, and the sucking and compressing efficiency can be enhanced, as in the first embodiment.

What is claimed is:

1. A hermetic compressor comprising a plurality of compressing mechanisms each of which includes a rotary cylinder having a groove, and a piston which is slidable in said groove, so that a compressing stroke is carried out by rotation of said piston on a locus of a radius E about a point spaced apart at a distance E from the center of said rotary cylinder; a partition plate being interposed between said rotary cylinders of the adjacent compressing mechanisms, said partition plate being provided with a communication bore through which a shaft is passed, said shaft being provided with cranks on which said pistons can be mounted; and a motor mechanism for driving said pistons of said compressing mechanisms by the common shaft, at least one of said compressing mechanisms being different in phase in a compressing stroke from the other compressing mechanisms, said rotary cylinders of the adjacent compressing mechanisms and said partition plate sandwiched between said rotary cylinders being formed from different members, and relatively non-rotatably connected to each other.

2. A hermetic compressor according to claim 1, wherein said rotary cylinder and said partition plate are formed of disks, respectively.

3. A hermetic compressor according to claim 2, wherein said rotary cylinder and said partition plate have through-bores defined therein, respectively, so that said rotary cylinder and partition plate are fixed by bolts inserted through said through-bores, said through-bores being disposed at locations where they are not aligned with an intake port and a discharge port for permitting a gas to flow into and out of said compressing mechanism.

4. A hermetic compressor according to claim 3, wherein said through-bore defined in the rotary cylinder is provided with a larger-diameter portion for receiving a head of said bolt.

5. A hermetic compressor according to claim 2, wherein said rotary cylinder and said partition plate have through-bore defined therein, respectively, so that said rotary cylinder and partition plate are fixed by pins fitted into said through-bores, said through-bores being disposed at locations where they are not aligned with an intake port and a discharge port for permitting a gas to flow into and out of said compressing mechanism.

6. A hermetic compressor according to claim 2, wherein said partition plate has pin-insertion bores defined therein, and each of said rotary cylinders located on opposite sides of said partition plate has bottomed pin-receiving bores defined therein, so that the relative rotation of said rotary cylinders of the adjacent compressing mechanisms is limited by pins inserted into said pin-receiving bores and said pin insertion bores.

7. A hermetic compressor according to claim 2, wherein said rotary cylinder and said partition plate are fitted in a recess-projection manner with each other by a recess and a projection formed on opposed faces thereof.

8. A hermetic compressor according to claim 2, wherein said rotary cylinder and said partition plate are fixed to each other by welding.

9. A hermetic compressor comprising a plurality of compressing mechanisms each of which includes a rotary cylinder having a groove, and a piston which is slidable in said groove, so that a compressing stroke is carried out by rotation of said piston on a locus of a radius E about a rotational center provided by a location spaced at a distance E apart from the center of said rotary cylinder; a partition plate being interposed between said rotary cylinders of the adjacent compressing mechanisms, said partition plate being provided with a communication bore through which a shaft is passed, said shaft being provided with cranks on which said pistons can be mounted; and a motor mechanism for driving said pistons of said compressing mechanisms by the common shaft, at least one of said compressing mechanisms being different in phase in a compressing stroke from the other compressing mechanism, said rotary cylinders of the adjacent compressing mechanisms and said partition plate sandwiched between said rotary cylinders being formed from an integrally formed piece.

10. A hermetic compressor comprising first and second compressing mechanisms each of which includes a rotary cylinder having a groove, and a piston which is slidable in said groove, so that a compressing stroke is carried out by rotation of said piston on a locus of a radius E about a rotational center provided by a location spaced at a distance E apart from the center of said rotary cylinder, all said rotary cylinders being connected together, all said pistons being driven by a common shaft, and said first and second compressing mechanisms being different in phase in a compressing stroke, said first and second compressing mechanisms being mounted between an upper bearing and a lower bearing, said upper bearing having an intake port and a discharge port provided therein for said first compressing mechanism, and said lower bearing having an intake port and a discharge port provided therein for said second compressing mechanism, said intake ports and said discharge ports being provided so that they do not communicate simultaneously with a compressive space defined by said rotary cylinder and said piston at all rotational angles of said shaft.

11. A hermetic compressor according to claim 10, wherein said intake port is disposed so that it communicates with the compressive space which is in a volume-increasing course, at positions of all rotational angles excluding a suction starting point where the volume of said compressive space is smallest (minimum) and a suction completing point where said compressive space is largest (maximum).

12. A hermetic compressor according to claim 10, wherein said discharge port is comprised of a plurality of ports spaced apart from one another along a side edge of said groove at a position of a rotational angle of the rotary cylinder at the time when the compressive space is smallest or largest, said plurality of ports being provided with discharge valves, respectively, and disposed at locations where they do not communicate with the compressive space at a compression starting point and a compression completing point in the compressive space.

13. A hermetic compressor comprising first and second compressing mechanisms which are mounted within a casing and each of which includes a rotary cylinder having a groove, and a piston which is slidable in said groove, so that the suction and compression are carried out by rotation of said piston on a locus of a radius E about a center provided by a point spaced at a distance E apart from the center of said rotary cylinder, said two rotary cylinders of said first and second compressing mechanisms being connected to each other at a location where said first and second compressing mechanisms are different in phase in a compressing stroke, said two pistons being driven by a common crankshaft, said piston being formed into a shape such that its sectional contour is comprised of two arcs and two parallel straight lines having a length a, said groove in said rotary cylinder being formed into a shape such that it is comprised of arcs assuming the substantially same shape as said arcs forming said piston, and two parallel straight lines having a length of 4 E+a.

14. A hermetic compressor according to claim 13, wherein the sectional contour of said piston is formed by cutting a cylindrical member in parallel.

15. A hermetic compressor according to claim 13, wherein said arc forming the sectional contour of said piston is semi-circular.

16. A hermetic compressor comprising first and second compressing mechanisms each of which includes a rotary cylinder having a groove, and a piston which is slidable in said groove, so that a compressing stroke is carried out by rotation of said piston on a locus of a radius E about a rotational center provided by a location spaced at a distance E apart from the center of said rotary cylinder, all said rotary cylinders being connected together, all said pistons being driven by a common shaft, and said first and second compressing mechanisms being different in phase in a compressing stroke, said first and second compressing mechanisms being mounted between an upper bearing and a lower bearing, said upper bearing having an intake port and a discharge port provided therein for said first compressing mechanism, and said lower bearing having an intake port and a discharge port provided therein for said second compressing mechanism, said intake ports and said discharge ports being provided so that they do not communicate simultaneously with a compressive space defined by said rotary cylinder and said piston at all rotational angles of said shaft;

said intake port being disposed so that it communicates with the compressive space which is in a volume—increasing course, at positions of all rotational angles excluding a suction starting point where the volume of said compressive space is smallest (minimum) and a suction completing point where said compressive space is largest (maximum); and said intake port having a crescent shape extending along a side edge of said groove at a position of a rotational angle of said rotary cylinder at the time when the compressive space is smallest or largest, an outer edge of said crescent shape being formed into an arc conforming with and extending along a locus of movement of an end edge of said groove.

* * * * *